US009687413B2

(12) United States Patent
Shaltis

(10) Patent No.: US 9,687,413 B2
(45) Date of Patent: Jun. 27, 2017

(54) COMPRESSION GARMENT INFLATION

(71) Applicant: Covidien LP, Mansfield, MA (US)

(72) Inventor: Phillip Shaltis, Sharon, MA (US)

(73) Assignee: Covidien LP, Mansfield, MA (US)

( * ) Notice: Subject to any disclaimer, the term of this patent is extended or adjusted under 35 U.S.C. 154(b) by 583 days.

(21) Appl. No.: 14/182,549

(22) Filed: Feb. 18, 2014

(65) Prior Publication Data

US 2015/0231022 A1 Aug. 20, 2015

(51) Int. Cl.
*A61H 9/00* (2006.01)
*A61H 7/00* (2006.01)

(52) U.S. Cl.
CPC ..... *A61H 9/0078* (2013.01); *A61H 9/0092* (2013.01); *A61H 2201/5002* (2013.01); *A61H 2201/5056* (2013.01); *A61H 2209/00* (2013.01)

(58) Field of Classification Search
CPC ..... A61H 9/0078; A61H 9/0092; A61H 2201/5056; A61H 2201/5002; Y10T 137/86638
USPC ..... 137/625.11, 625.12, 625.15, 625.21, 137/625.22; 5/655.3, 706, 710, 713
See application file for complete search history.

(56) References Cited

U.S. PATENT DOCUMENTS 2,781,041 A 2/1957 Weinberg
3,411,496 A * 11/1968 Strehler ..... A61H 9/0078 601/150
3,811,431 A 5/1974 Apstein
3,862,629 A * 1/1975 Rotta ..... A61H 9/0078 128/DIG. 10
3,866,604 A 2/1975 Curless et al.
4,029,087 A 6/1977 Dye et al.
4,197,837 A 4/1980 Tringali et al.
4,408,599 A 10/1983 Mummert
4,428,368 A 1/1984 Torii
4,583,255 A 4/1986 Mogaki et al.
4,617,933 A 10/1986 Hasson
4,838,263 A 6/1989 Warwick et al.
(Continued)

FOREIGN PATENT DOCUMENTS

EP 2181675 A1 5/2010
IT EP 2181675 A1 * 5/2010 ..... A61F 5/01

OTHER PUBLICATIONS

Office Action dated Jun. 1, 2016 in related Chinese Application No. 201510029330.8, 17 pages.

*Primary Examiner* — Justine Yu
*Assistant Examiner* — Douglas Sul
(74) *Attorney, Agent, or Firm* — Blaine A. Page, Esq.

(57) ABSTRACT

A compression garment includes a plurality of inflatable bladders, a valve body, an inlet, an exhaust, and a rotary valve. The plurality of inflatable bladders is positionable around a limb of a wearer. The manifold defines a plurality of bladder ports, each bladder port in fluid communication with a respective inflatable bladder. The inlet defines an inlet port, and the exhaust defines an exhaust port. The rotary valve is in fluid communication with the inlet port, the exhaust port, and the plurality of bladder ports. Rotation of the valve in a first direction controls fluid communication between the inlet port and the plurality of bladder ports, and rotation of the valve in a second direction, opposite the first direction, controls fluid communication between the exhaust port and the plurality of bladder ports.

12 Claims, 23 Drawing Sheets

(56) References Cited

U.S. PATENT DOCUMENTS

| | | | | |
|---|---|---|---|---|
| 5,233,974 | A * | 8/1993 | Senoue | A61H 9/0078 5/713 |
| 5,245,990 | A | 9/1993 | Bertinin | |
| 5,250,055 | A | 10/1993 | Moore et al. | |
| 5,379,471 | A * | 1/1995 | Holdredge | A61G 5/1043 297/DIG. 8 |
| 5,437,646 | A | 8/1995 | Hunt et al. | |
| 5,496,289 | A | 3/1996 | Wenstrom, Jr. | |
| 5,676,639 | A | 10/1997 | Schild | |
| 5,746,720 | A | 5/1998 | Stouder, Jr. | |
| 6,355,008 | B1 | 3/2002 | Nakao | |
| 6,589,267 | B1 | 7/2003 | Hui | |
| 6,698,046 | B1 | 3/2004 | Wu | |
| 7,704,263 | B2 | 4/2010 | Morris et al. | |
| 7,828,775 | B2 | 11/2010 | Okoniewski | |
| 7,866,344 | B2 * | 1/2011 | Webster | F16K 11/074 137/596.17 |
| 8,043,319 | B2 | 10/2011 | Lyon et al. | |
| 8,156,589 | B2 * | 4/2012 | Liu | A47C 27/082 5/655.3 |
| 8,177,734 | B2 | 5/2012 | Vess | |
| 8,231,561 | B2 | 7/2012 | Siegner | |
| 2002/0091345 | A1 | 7/2002 | Hazard | |
| 2002/0121307 | A1 * | 9/2002 | Stacy | A61G 7/05776 137/624.13 |
| 2004/0035474 | A1 * | 2/2004 | Weiss | F16K 11/074 137/624.11 |
| 2005/0027218 | A1 | 2/2005 | Filtvedt et al. | |
| 2005/0096507 | A1 | 5/2005 | Prosek | |
| 2005/0107725 | A1 | 5/2005 | Wild et al. | |
| 2006/0264903 | A1 | 11/2006 | Walker | |
| 2009/0120520 | A1 * | 5/2009 | Weiss | F16K 11/0743 137/625.46 |
| 2009/0227914 | A1 | 9/2009 | Kanaoka | |
| 2009/0299239 | A1 | 12/2009 | Meyer et al. | |
| 2010/0100045 | A1 | 4/2010 | Pravongviengkham et al. | |
| 2010/0318033 | A1 | 12/2010 | Lam | |
| 2011/0034775 | A1 | 2/2011 | Lozman et al. | |
| 2011/0144440 | A1 | 6/2011 | Cropper et al. | |
| 2011/0144448 | A1 | 6/2011 | Shelton, IV et al. | |
| 2012/0245426 | A1 | 9/2012 | Salvas et al. | |

* cited by examiner

COMPRESSION GARMENT INFLATION

BACKGROUND

Compression garments for applying compressive forces to a selected area of a wearer's body are generally used to improve blood flow in the selected area. Compression garments in which intermittent pulses of compressed air are delivered to one or more inflatable bladders in a cuff or sleeve of the garment are particularly useful. This cyclic application of pressure provides a non-invasive method of prophylaxis to reduce the incidence of deep vein thrombosis (DVT) and to improve blood flow.

When multiple bladders are used, compression therapy may include the sequential inflation of the bladders to move blood along the selected area. In some compression garments, a microprocessor controls operation of a pneumatic pump and valves control the sequence of bladder inflation.

SUMMARY

A rotary valve rotates to control inflation and deflation of one or more bladders of a compression garment.

In one aspect, a compression garment includes a plurality of inflatable bladders, a valve body, an inlet, an exhaust, and a rotary valve. The plurality of inflatable bladders is positionable around a limb of a wearer. The valve body defines a plurality of bladder ports, each bladder port in fluid communication with a respective inflatable bladder. The inlet defines an inlet port, and the exhaust defines an exhaust port. The rotary valve is in fluid communication with the inlet port, the exhaust port, and the plurality of bladder ports. Rotation of the valve in a first direction controls fluid communication between the inlet port and the plurality of bladder ports, and rotation of the valve in a second direction, opposite the first direction, controls fluid communication between the exhaust port and the plurality of bladder ports.

In some embodiments, rotation of the rotary valve in the first direction brings the bladder ports sequentially into fluid communication with the inlet port. Additionally or alternatively, rotation of the rotary valve in the second direction brings the bladder ports sequentially into fluid communication with the exhaust port.

In some embodiments, rotation of the rotary valve in the first direction brings all of the bladder ports simultaneously into fluid communication with the inlet port.

In another aspect, a compression garment includes a plurality of inflatable bladders, an inlet, a valve body, a plurality of bladder ports, and a rotary valve. The plurality of inflatable bladders is positionable around a limb of a wearer. The inlet defines an inlet port, and the valve body defining at least a portion of a manifold in fluid communication with the inlet port. Each bladder port is in fluid communication with a respective inflatable bladder, and the rotary valve is in fluid communication with the manifold and the plurality of bladder ports. Rotation of the rotary valve in a first direction brings the bladder ports sequentially into fluid communication with the inlet port.

In some embodiments, the rotary valve is rotatable relative to the inlet and the manifold in a second direction to exhaust fluid (e.g., air).

In certain embodiments, the garment further includes an energy storage device coupled to the rotary valve such that energy of rotation of the rotary valve in the first direction is storable in the energy storage device. For example, the energy storage device can include a torsion spring in mechanical communication with the rotary valve.

In certain embodiments, the rotary valve includes a valve member and a valve arm attached to the valve member such that the valve arm projects from the valve member for sliding sealing engagement with the valve body.

In some embodiments, the valve body includes an inner wall, and the bladder ports open into the manifold through the inner wall.

In certain embodiments, the valve arm is disposed in the valve body such that a free end of the valve arm is in sliding sealing contact with the inner wall of the valve body along the manifold.

In some embodiments, the compression garment further includes a stop disposed in the manifold. The valve arm can be engageable with the stop for preventing further rotation of the rotary valve in the first direction.

In certain embodiments, the valve arm is disposed with respect to the inlet such that the rotary valve is rotatable under the force of fluid moving through the inlet and impinging on the valve arm.

In some embodiments, the compression garment further includes an exhaust defining an exhaust port in fluid communication with the rotary valve, and the rotary valve is biased to place the bladder ports in fluid communication with the exhaust port.

In certain embodiments, the compression garment further includes a flap movable between a first position sealing the inlet when one or more of the bladders ports is in fluid communication with the exhaust, and a second position sealing the exhaust.

In still another aspect, a compression garment includes a plurality of inflatable bladders, an inlet, a valve body, a plurality of bladder ports, and a disc-type rotary valve. The plurality of inflatable bladders is positionable around a limb of a wearer. The inlet defines an inlet port. The valve body defines at least a portion of a manifold in fluid communication with the inlet port. Each of the plurality of bladder ports is in fluid communication with a respective inflatable bladder. The disc-type rotary valve is in fluid communication with the inlet port and the plurality of bladder ports. The disc-type rotary valve has a first surface facing the inlet and a second surface facing the plurality of bladder ports. The disc-type rotary valve defines radially spaced and circumferentially extending arcuate channels. Each channel corresponds to a respective bladder port, and each channel establishes fluid communication between the respective bladder port and the inlet port upon rotation of the disc-type rotary valve.

In some embodiments, each arcuate channel has a different arc length.

In certain embodiments, each arcuate channel has a first end and a second end, the respective first ends of the channels circumferentially offset from each other. Additionally or alternatively, the respective second ends of the channels are circumferentially aligned with each other.

In certain embodiments, the arcuate channels have different cross sectional areas. Additionally or alternatively, the arcuate channels have different widths.

In certain embodiments, the arcuate channels each have a different length and a different area. For example, the arcuate channel having the shortest length can have the greatest cross sectional area, and the arcuate channel having the greatest length can have the smallest cross sectional area.

Embodiments can include one or more of the following advantages.

In some embodiments, a rotary valve assembly of a compression system mechanically controls sequential inflation of bladders of a compression garment. Such mechanical control can reduce the need to electronically program a controller to control one or more valves to achieve sequential inflation of multiple bladders. Thus, for example, the use of a rotary valve assembly to mechanically control sequential inflation of bladders can reduce or, in some instances, eliminate the complexity associated with a programmable controller (e.g., decrease programming of the controller and/or smaller overall unit size). Additionally or alternatively, the use of a rotary valve assembly to mechanically control sequential inflation of bladders can make sequential compression therapy available to patients in areas in which connection to a plug power source is not available. For example, compression systems including a rotary valve can have reduced power demands (e.g., by virtue of reduced reliance on a programmable controller) that can be supplied through one or more batteries.

In certain embodiments, a rotary valve assembly of a compression system sequentially inflates bladders of a compression garment using a constant volume source of air. Thus, as compared to compression systems relying on an electronic controller, the rotary valve assembly can reduce the complexity associated with controlling a pump such that a constant volume source of air can be used to sequentially inflate the bladders of the compression system.

In some embodiments, sequential inflation of bladders of a compression garment is achieved using only a rotary valve of a compression system. Thus, as compared to compression systems including an electromechanically controlled valve associated with each of a plurality of bladders, the rotary valve of the compression system can reduce the complexity of the compression system. Such reduced complexity can, for example, result in a smaller system and/or a more robust compression system.

Other aspects, embodiments, features, and advantages will be apparent in view of the following description and drawings, and from the claims.

BRIEF DESCRIPTION OF THE DRAWINGS

Corresponding reference characters indicate corresponding parts throughout the drawings.

DETAILED DESCRIPTION

Figure 1:
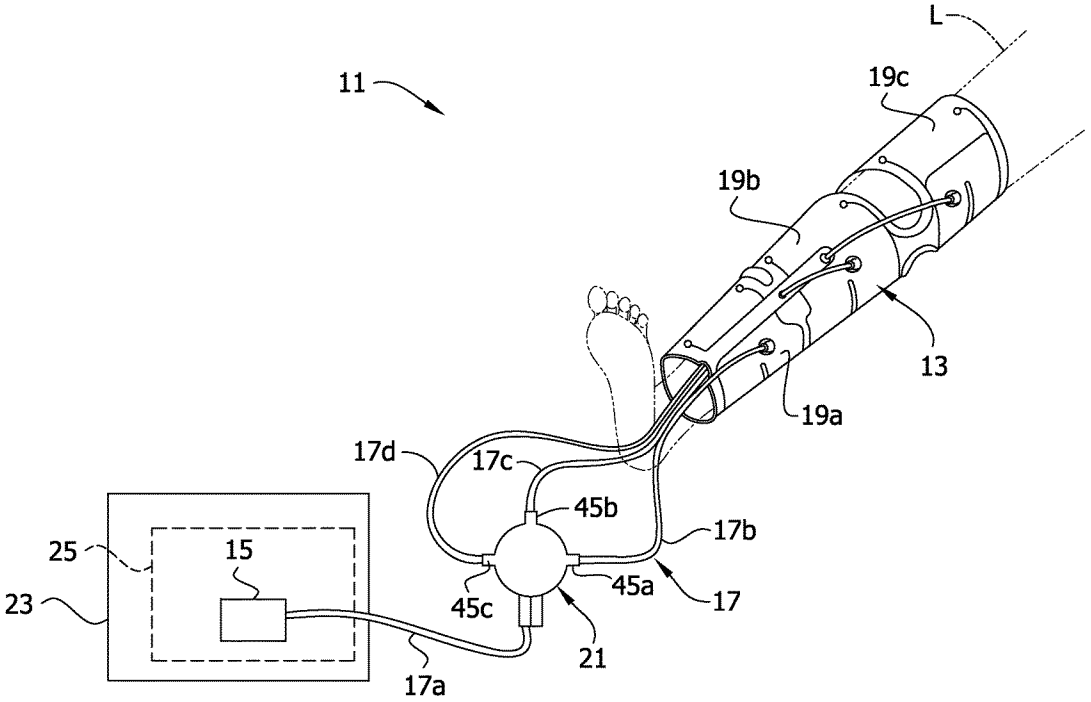
FIG. 1 is a schematic representation of a compression system including a compression garment applied to a subject's leg.

Referring to FIG. 1, a compression system 11 applies compression therapy (e.g., repeated and/or sequential compression therapy) to a limb of a wearer. The compression system 11 includes a compression garment 13, a pump 15, a valve assembly 21, and a controller 23. The compression garment 13 includes bladders 19*a*, 19*b*, 19*c* and is positionable around a leg L or other limb of a wearer.

The pump 15 is fluidly connectable to the compression garment 13 through tubing 17 for introducing gas (e.g., air) into the bladders 19*a*, 19*b*, 19*c* to apply compression therapy to the leg L. The valve assembly 21 is connected to segments of the tubing 17 and, as described below, controls inflation and deflation of the bladders 19*a*, 19*b*, 19*c* such that the bladders 19*a*, 19*b*, 19*c* are selectively inflated and deflated. The pump 15 may deliver a constant volume of air to the valve assembly 21. The controller 23 includes a processor 25 operatively connected to the pump 15 to control operation of the pump 15 (e.g., to control on/off operation of the pump 15). As described in greater detail below, the valve assembly 21 facilitates application of sequential compression therapy to the wearer's limb by sequentially inflating the bladders 19*a*, 19*b*, 19*c*. As compared to compression systems including other types of valves that require electrical communication with a controller, the valve assembly 21 operates under the force of air provided from the pump 15 and, for at least this reason, can be implemented using simplified controls. For example, the valve assembly 21 can be used to control the sequence of bladder inflation/deflation without having to program the controller 23 to control the position of the valve assembly 21.

The garment 13 is a thigh-length sleeve with a first bladder 19*a* positionable over the wearer's ankle, the second bladder 19*b* positionable over the wearer's calf, and the third bladder 19*c* positionable over the wearer's thigh. It will be understood that the compression garment 13 may come in different sizes, such as a knee-length size extending from the ankle up to the knee of the leg. Additionally or alternatively, the compression garment 13 can be positionable about other parts of the wearer's body. For example, the garment may be a foot cuff. In operation, the first bladder 19*a* is inflated first, followed by the second bladder 19*b* and then the third bladder 19*c*, resulting in peristaltic action on the leg L that moves blood out of the leg, toward the heart.

Figure 2:
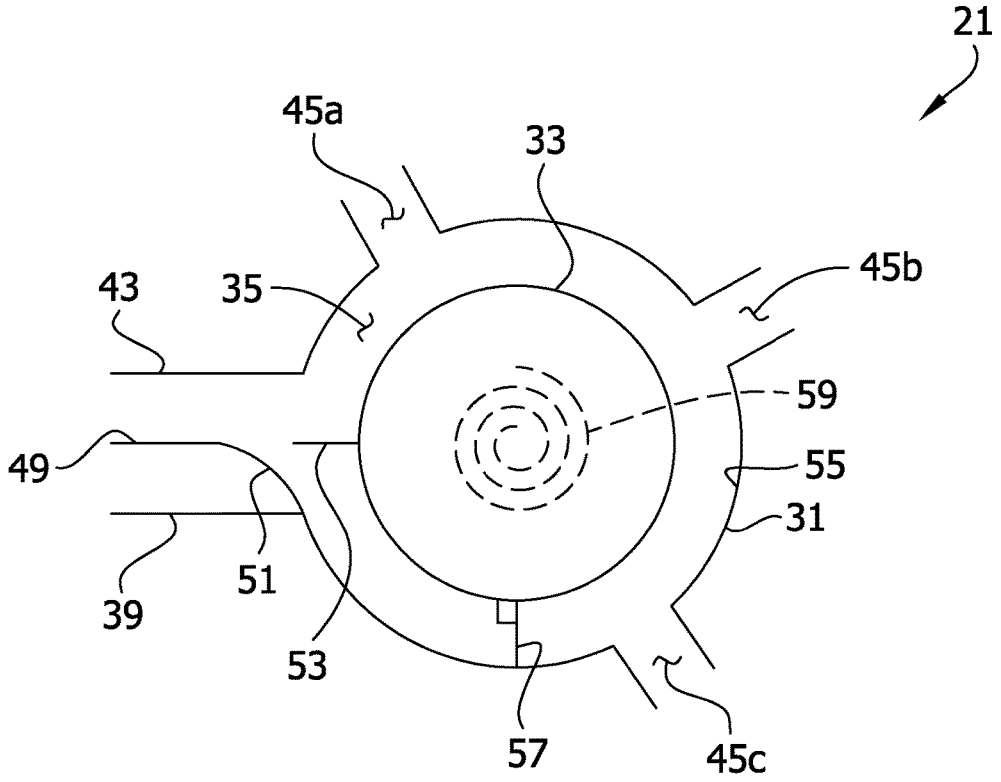
FIG. 2 is a plan view of an inner portion of a rotary valve assembly of the compression system of FIG. 1, with a valve mechanism of the rotary valve assembly shown in a first, vent position.
Figure 3:
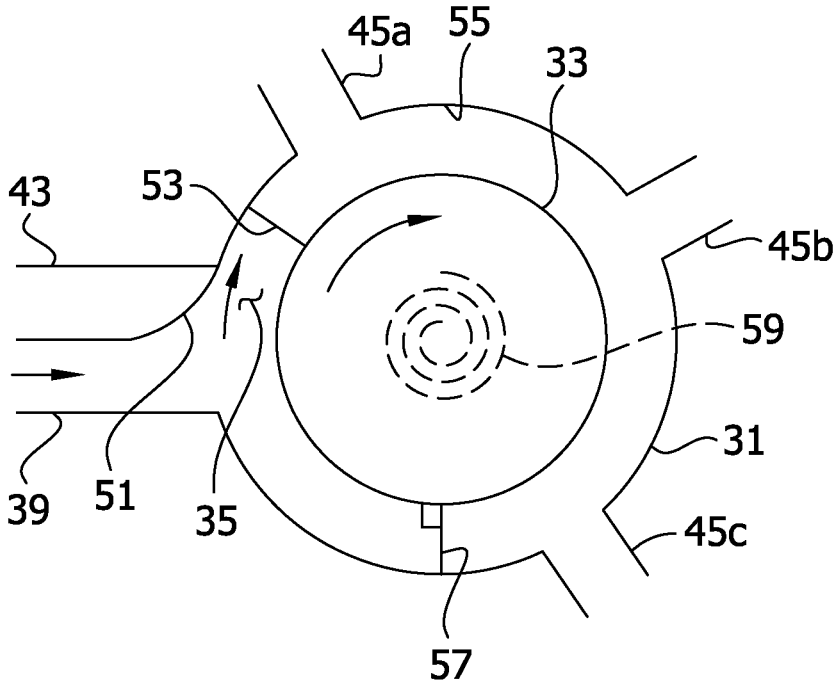
FIG. 3 is the plan view of the inner portion of the rotary valve assembly of FIG. 2, with the valve mechanism of the rotary valve assembly shown in a second position.

Referring now to FIGS. 1-3, the valve assembly 21 includes a valve body 31 and a rotary valve 33 disposed within the valve body 31. A manifold 35 is defined between the valve body 31 and the rotary valve 33. In use, pressurized fluid from the pump 15 moves through the manifold 35 to act on the rotary valve 33, which is rotatable relative to the valve body 31 to cause sequential inflation of the bladders 19*a*, 19*b*, 19*c* of the garment 13, as will be explained in greater detail below.

The valve body 31 includes an inlet port 39 and an exhaust port 43. The inlet port 39 establishes fluid communication between the manifold 35 and the pump 15 such that pressurized fluid from the pump 15 enters the manifold 35 through the inlet port 39. The exhaust port 43 establishes fluid communication between the manifold 35 and the exterior of the valve assembly 21 such that pressurized fluid is exhausted to the ambient surroundings of the valve assembly 21 via the exhaust port 43.

A divider wall 49 separates the inlet portion 39 from the exhaust portion 43. A valve flap 51 is attached to the divider wall 49 and seals the inlet port 39 from the manifold 35. The valve flap 51 may be biased to close the inlet port 39 and open the exhaust port 43. Such biasing of the valve flap can act as a fail-safe to exhaust pressurized fluid from the valve assembly 21, for example in the event of a malfunction associated with the pump 15 and/or interruption of fluid communication between the pump 15 and the valve assembly 21.

First, second, and third bladder ports 45*a*, 45*b*, 45*c*, respectively, are defined by the valve body 31 and are circumferentially spaced around the manifold 35. The bladder ports 45*a*, 45*b*, 45*c* are in fluid communication with the respective first, second, and third bladders 19*a*, 19*b*, 19*c*. In some embodiments, the bladder ports 45*a*, 45*b*, 45*c* each have substantially the same resistance to flow (e.g., have the same open area) of pressurized fluid from the pump 15. In certain embodiments, the bladder ports 45*a*, 45*b*, 45*c* each have different amounts of resistance to flow (e.g., have different open areas) of pressurized fluid from the pump 15.

A valve arm 53 is attached to the rotary valve 33 and, thus, rotates with the rotary valve 33. During rotation of the rotary valve 33, the valve arm 53 sealingly engages an inner wall 55 of the valve body 31. The sealing engagement of the valve arm 53 to the inner wall 55 of the valve body 31 substantially limits the flow of pressurized fluid past the valve arm 53, resulting in direction of all or substantially all (e.g., greater than about 95%, by volume) of the pressurized fluid from the pump to one or more of the bladders 19*a*, 19*b*, 19*c*.

A stop 57 disposed in the manifold 35 limits rotation of the rotary valve 33 by engaging the valve arm 53 to stop rotation of the rotary valve 33 at the angular position of the stop 57. A torsion spring 59 biases the rotary valve 33 toward the exhaust orientation (shown, for example, in FIG. 2), in which the exhaust port 43 is in fluid communication with the bladder ports 45*a*, 45*b*, 45*c*, as described in greater detail below.

The inlet port 39 of the valve assembly 21 is in fluid communication with a pump section 17*a* of the tubing 17 such that the inlet port is in fluid communication with the pump 15. The first bladder port 45*a* is in fluid communication with a first bladder section 17*b* of the tubing 17 such that the manifold 35 is in fluid communication with the first bladder 19*a*. The second bladder port 45*b* is in fluid communication with a second bladder section 17*c* of the tubing 17 such that the manifold 35 is in fluid communication with the second bladder 19*b*. The third bladder port 45*c* is in fluid communication with a third bladder section 17*d* of the tubing 17 such that the manifold 35 is in fluid communication with the third bladder 19*c*. In some embodiments, one or more of the pump section 17*a*, the first bladder section 17*b*, the second bladder section 17*c*, and the third bladder section 17*d* of the tubing 17 are releasably attached to the valve assembly 21 to facilitate, for example, repair and/or placement of the valve assembly 21 and/or the tubing 17.

During use, the pump 15 delivers pressurized fluid, through the pump section 17*a* of the tubing 17, to the inlet port 39 of the valve assembly 21. For example, the pressurized fluid can be air, delivered at a substantially constant volume (e.g., less than about ±10% variation in volume) at a pressure of less than about 200 mmHg.

Prior to pressurized fluid entering the valve assembly 21, the rotary valve 33 is arranged in an exhaust orientation, in which the exhaust port 43 is in fluid communication with the bladder ports 45*a*, 45*b*, 45*c*, allowing the bladders 19*a*, 19*b*, 19*c* to vent to atmosphere (FIG. 2). The spring 59 is attached to the rotary valve 33 to bias the valve assembly 21 toward the exhaust orientation. Such biasing of the valve assembly 21 toward the exhaust orientation can act as a fail-safe to exhaust pressurized fluid from the valve assembly 21, for example, in the event of a malfunction associated with the pump 15 and/or interruption of fluid communication between the pump 15 and the valve assembly 21.

As pressurized fluid from the pump 15 enters the inlet port 39 and impinges on the valve flap 51, the fluid pressure causes the flap 51 to pivot from a position obstructing the inlet port 19 to a position obstructing the exhaust port 43, sealing off the exhaust port (as shown, for example, in FIG. 3). As the valve flap 51 moves from the position obstructing the inlet port 39, the pressurized fluid moving past the valve flap 51 also impinges on the valve arm 53, causing the valve arm and rotary valve 33 to rotate in the valve body 31.

Rotation of the valve arm 53 to the position shown in FIG. 3 provides sufficient clearance for the valve flap 51 to flip from the inlet port 39 to the exhaust port 43, sealing the exhaust port 43. The valve arm 53 and rotary valve 33 continue to rotate (in a clockwise direction in the orientation shown in FIG. 3) as pressurized fluid flows into the manifold 35 and impinges on the valve arm 53.

Figure 4:
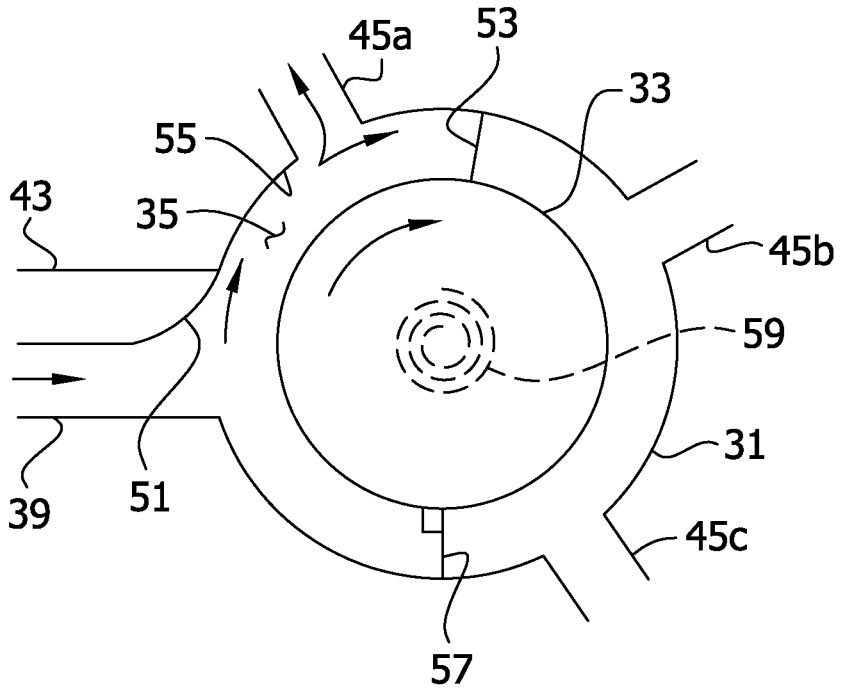
FIG. 4 is the plan view of the inner portion of the rotary valve assembly of FIG. 2, with the valve mechanism of the rotary valve assembly shown in a third position.

Referring now to FIG. 4, as the valve arm 53 rotates past the first bladder port 45*a*, the manifold 35 is placed in fluid communication with the first bladder port 45*a*, which is in fluid communication with the first bladder 19*a* via the first bladder section 17*b* of the tubing 17. With the manifold 35 in fluid communication with the first bladder port 45*a*, pressurized fluid flows into the first bladder 19*a* to begin inflating the first bladder 19*a*.

Fluid flow into the first bladder 19*a* momentarily slows or stops rotation of the rotary valve 33 as fluid pressure on the valve arm 53 decreases while fluid moves into the first bladder 19*a*. Once the pressure in the manifold 35 and first bladder 19*a* increases, the bias of the spring 59, can be overcome and the valve arm 53 and rotary valve 33 can continue to rotate (in the clockwise direction in the orientation shown in FIG. 4).

Figure 5:
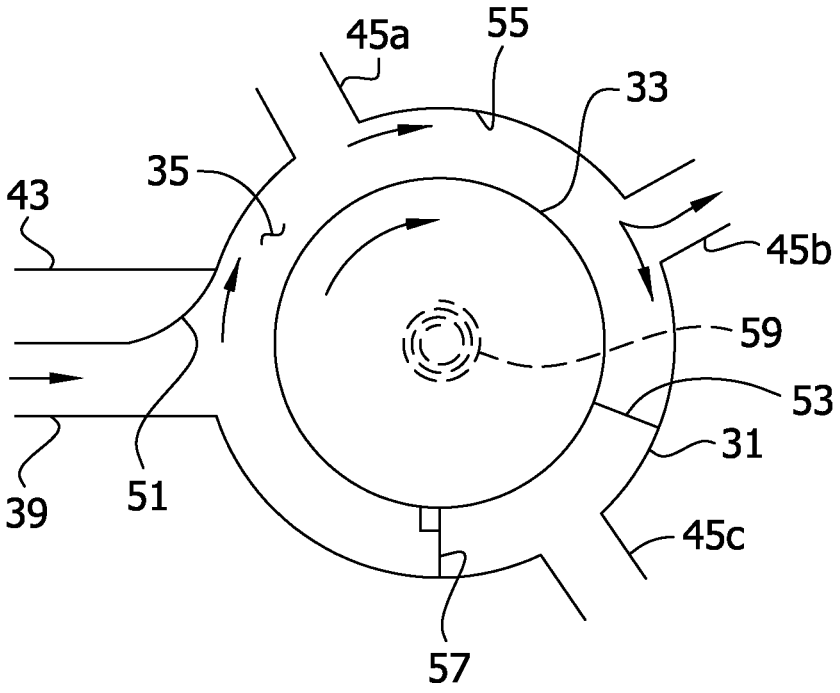
FIG. 5 is the plan view of the inner portion of the rotary valve assembly of FIG. 2, with the valve mechanism of the rotary valve assembly shown in a fourth position.

Referring now to FIG. 5, when the valve arm 53 rotates past the second bladder port 45*b*, the manifold 35 is in fluid communication with the second bladder port 45*b* and the second bladder 19*b*, which is in fluid communication with the second bladder port 45*b* via the second bladder section 17*c*. With the valve arm 53 in this position, the pressurized fluid flows into the second bladder 19*b* to begin filling the second bladder 19*b* with pressurized fluid. In a manner analogous to that described above with respect to the first bladder 19*a*, fluid flow into the second bladder 19*b* momentarily slows or stops rotation of the rotary valve 33 as the fluid pressure on the valve arm 53 decreases while pressurized fluid moves into the second bladder 19*b*. Once the pressure in the manifold 35 and the second bladder 19*b* increases, the bias of the spring 59 can be overcome and the valve arm 53 and rotary valve 33 can continue to rotate (in the clockwise direction in the orientation shown in FIG. 5).

Figure 6:
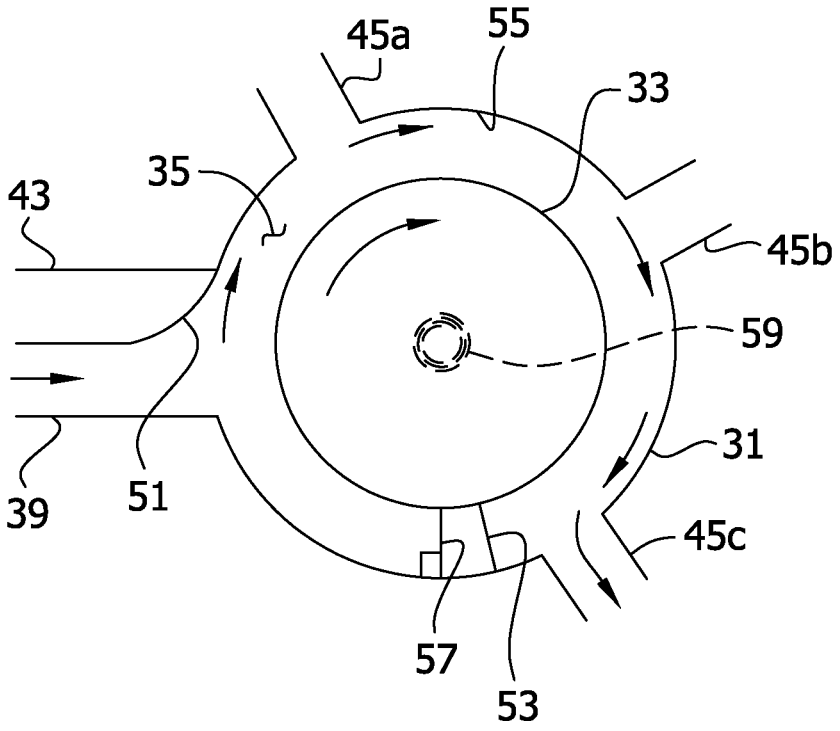
FIG. 6 is the plan view of the inner portion of the rotary valve assembly of FIG. 2, with the valve mechanism of the rotary valve assembly shown in a fifth position.

Referring now to FIG. 6, when the valve arm 53 rotates past the third bladder port 45*c*, the manifold 35 is in fluid communication with the third bladder port 45*c* and the third bladder 19*c*, which is in fluid communication with the third bladder port 45*c* via the third bladder section 17*d* of the tubing 17. With the valve arm 53 in this position, the pressurized fluid can flow into the third bladder 19*c* to begin filling the third bladder 19*c* with pressurized fluid. In a manner analogous to that described above with respect to the first and second bladders 19*a*, 19*b*, the pressurized fluid flowing into the third bladder 19*c* momentarily slows or stops rotation of the rotary valve 33 as the fluid pressure on the valve arm 53 decreases while the pressurized fluid moves into the third bladder 19*c*. Once the pressure in the manifold 35 and third bladder 19*c* increases, the bias of the spring 59 can be overcome and the valve arm 53 and the rotary valve 33 can continue to rotate (in the clockwise direction in the orientation shown in FIG. 6).

As the valve arm 53 continues to rotate (in the clockwise direction in FIG. 6), further rotation of the valve arm 53 is prevented when the valve arm 53 engages the stop 57. At this point, all three bladders 19*a*, 19*b*, 19*c* are inflated and in fluid communication with the manifold 35. Thus, it should be appreciated that the bladders 19*a*, 19*b*, 19*c* are sequentially inflated using only the mechanical configuration of the valve assembly 21. For example, the sequential inflation of the bladders 19*a*, 19*b*, 19*c* can be achieved by controlling the flow of pressurized fluid through the manifold 35 (e.g., by controlling whether the pump 15 is on or off). Such sequential inflation of the bladders 19*a*, 19*b*, 19*c* can reduce, for example, the complexity, power demands, and/or the size of the controller 23

To deflate the bladders 19*a*, 19*b*, 19*c*, the flow of pressurized fluid to the rotary valve assembly 21 is stopped (e.g., by turning off the pump 15). With the flow of pressurized fluid stopped, the bias force of the flap 51 causes the flap 51 to pivot back over the inlet port 39, and the bias force of the spring 59 causes the rotary valve 33 to rotate back to the exhaust configuration, in which the bladder ports 45*a*, 45*b*, 45*c*, and corresponding bladders 19*a*, 19*b*, 19*c*, are in fluid communication with the exhaust port 43. With the bladders 19*a*, 19*b*, 19*c* in fluid communication with the exhaust port 43, the pressurized fluid in the bladders 19*a*, 19*b*, 19*c* exhausts to the atmosphere, resulting in deflation of the bladders 19*a*, 19*b*, 19*c* as the pressure in each bladder 19*a*, 19*b*, 19*c* approaches atmospheric pressure. Thus, it will be appreciated that deflation of the bladders 19*a*, 19*b*, 19*c* is initiated in a reverse sequence from the sequence of inflation.

When it is desired to sequentially inflate the bladders 19*a*, 19*b*, 19*c* to provide compression therapy to the wearer's limb, the pump 15 is again activated to supply pressurized fluid to the valve assembly 21 to start the process over. Accordingly, repetitive cycling of on-off operation of the pump 15 can be used to apply repeated compression therapy to the wearer's limb.

While certain embodiments have been described, other embodiments are possible.

For example, while valve assemblies have been described as including three bladder ports, valve assemblies can include any number of bladder ports.

As another example, while valve assemblies have been described as having separate inlet and exhaust ports, valve assemblies may include a single port functioning, in use, as both an inlet and an exhaust.

As yet another example, while compression garments have been described as including three bladders, it should be appreciated that compression garments can have more or fewer than three bladders. Additionally or alternatively, each bladder may define a different volume.

As still another example, while the pump, controller, and tubing are shown as being separate from the compression garment, one or more of; a pump, a controller, and tubing may be incorporated into the garment. Additionally or alternatively, the controller can be omitted and the pump can be, for example, manually operated.

As still another example, while valve assemblies have been described as including rotary valves including rotating arms to control inflation of bladders, other valve assembly configurations are additionally or alternatively possible. For example, referring to FIGS. 7-17, a compression system 211 includes a compression garment 213, a pump 215, a valve assembly 221, and a controller 223. The compression garment 213 includes bladders 219*a*, 219*b*, 219*c* and is positionable around a leg L or other limb of a wearer.

The valve assembly 221 includes a manifold 231 and a disc-type rotary valve 233 disposed within the manifold 231. The disc-type rotary valve 233 is rotatable relative to the manifold 231, resulting in sequential inflation of bladders 219*a*, 219*b*, 219*c* of garment 213 when the valve assembly 221 is connected to the compression garment 215 and to the pump 215, as will be explained in greater detail below.

Referring to FIGS. 14A, 15A, 16A, and 17A, a fluid port 239 extends from a first surface 240 of the manifold 231. The fluid port 239 defines a passage 241 extending from an opening 243 defined by the fluid port 239 to a plenum 235 between the manifold 231 and the rotary valve 233. As described in further detail below, rotation of the rotary valve 233 controls the flow of pressurized air from the plenum 235 to bladder ports 245*a*, 245*b*, 245*c* extending from a second surface 242 of the manifold 231, with the second surface 242 opposite the first surface 240 of the manifold 231.

Each bladder port 245*a*, 245*b*, 245*c* defines a passage 246*a*, 246*b*, 246*c* extending through the respective bladder port 245*a*, 245*b*, 245*c* to a respective opening 248*a*, 248*b*, 248*c* defined by the bladder port 245*a*, 245*b*, 245*c*. Spring-loaded valve elements 250*a*, 250*b*, 250*c* are disposed within a respective bladder port 245*a*, 245*b*, 245*c* (e.g., at an end of each respective bladder port 245*a*, 245*b*, 245*c*). Each valve element 250*a*, 250*b*, 250*c* includes a respective spring 253*a*, 253*b*, 253*c* and a respective stop 254*a*, 254*b*, 254*c*.

The stops 254*a*, 254*b*, 254*c* are moveable between open and closed configurations. The stops 254*a*, 254*b*, 254*c* are each biased toward an open configuration in which the plenum 235 is in fluid communication with the respective bladder port 245*a*, 245*b*, 245*c*. Each stop 254*a*, 254*b*, 254*c* is moveable toward a closed configuration upon engagement with the rotary valve 233 to stop the flow of fluid from the plenum 235 to the respective bladder port 245*a*, 245*b*, 245*c*. As will be explained in greater detail below, rotation of the rotary valve 233 moves the valve elements 250*a*, 250*b*, 250*c* sequentially from an open position to a closed position to place the respective passage 246*a*, 246*b*, 246*c* in the respective bladder ports 245*a*, 245*b*, 245*c* in fluid communication with the plenum 235, resulting in sequential inflation of the bladders 219*a*, 219*b*, 219*c* of the compression garment 213.

Referring to FIGS. 11-14A the rotary valve 233 includes a first surface 236 and a second surface 237, with the first surface 236 opposite the second surface 237. Radially spaced and circumferentially extending first, second, and third arcuate channels 247*a*, 247*b*, 247*c* are defined by the rotary valve 233. Each arcuate channel 247*a*, 247*b*, 247*c* has a respective closed portion 249*a*, 249*b*, 249*c* and a respective open portion 251*a*, 251*b*, 251*c*. The open portions 251*a*, 251*b*, 251*c* of the arcuate channels 247*a*, 247*b*, 247*c* can be placed in fluid communication with respective bladder ports 245*a*, 245*b*, 245*c* through rotation of the rotary valve 233. The open portions 251*a*, 251*b*, 251*c* and the respective closed portions 249*a*, 249*b*, 249*c* of the arcuate channels 247*a*, 247*b*, 247*c* cooperate to guide the respective valve elements 250*a*, 250*b*, 250*c* as the rotary valve 233 rotates.

Figure 16A:
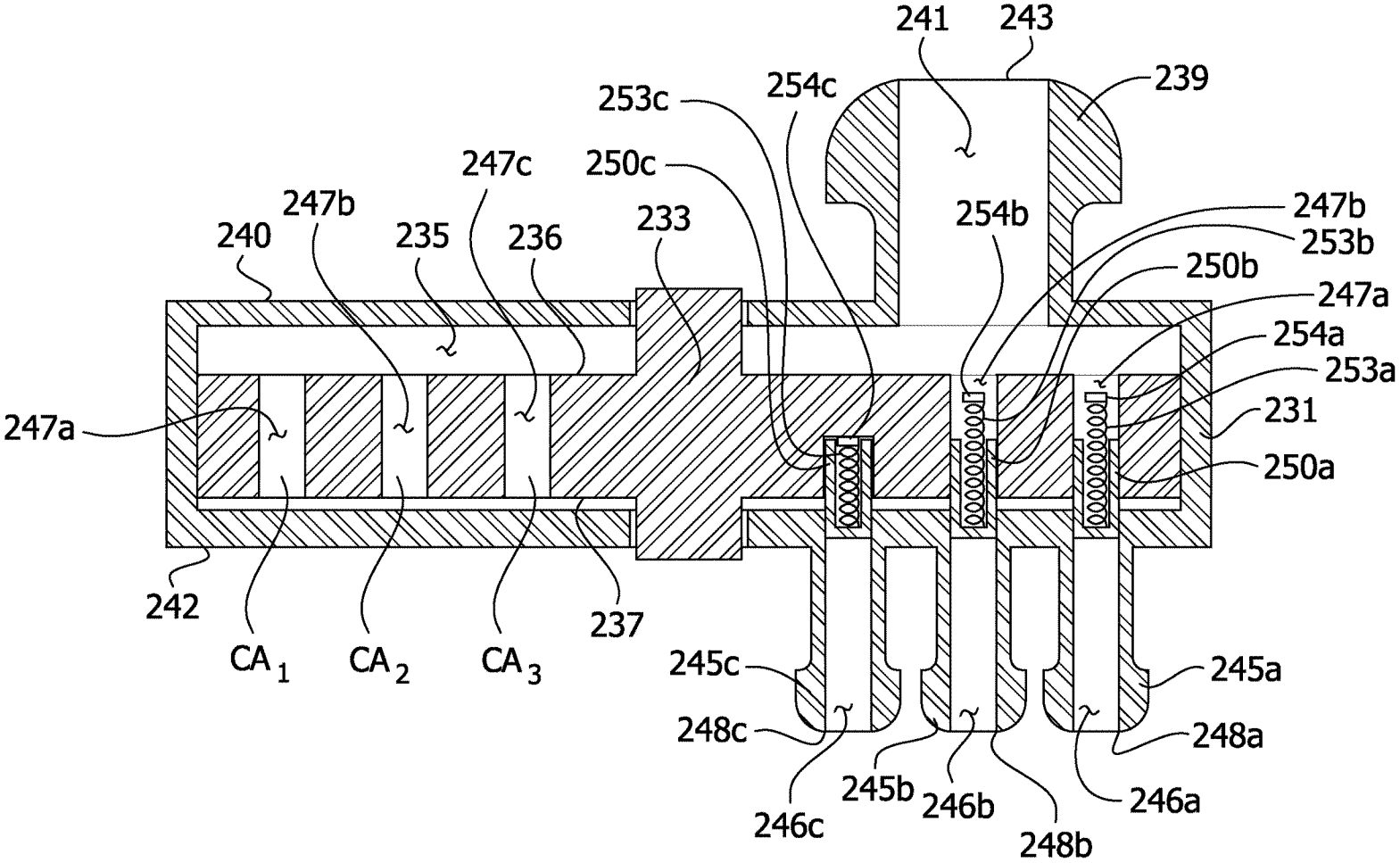
FIG. 16A is the cross-section of the valve assembly of FIGS. 7-10, taken through line A-A in FIG. 9, with the valve assembly shown in a third position.

The first arcuate channel 247*a* is disposed adjacent a periphery of the rotary valve 233 and is outermost relative to the second and third channels 247*b*, 247*c*. The first arcuate channel 247*a* includes the closed portion 249*a* and the open portion 251*a*. The open portion 251*a* of the first arcuate channel 247*a* has a circumferential length $L_1$, a width $W_1$, and a cross-sectional area $CA_1$ (FIG. 16A).

The second arcuate channel 247*b* is disposed adjacent the first arcuate channel 247*a* and is spaced radially inward from the first arcuate channel 247*a*. The second arcuate channel 247*b* includes the closed portion 249*b* and the open portion 251*b*. The open portion 251*b* of the second arcuate channel 247*b* has a circumferential length $L_2$, a width $W_2$, and a cross-sectional area $CA_2$ (FIG. 16A). The length $L_2$ of the open portion 251*b* of the second arcuate channel 247*b* is less than the length $L_1$ of the open portion 251*a* of the first arcuate channel 247*a*.

The third arcuate channel 247*c* is disposed adjacent the second channel 247*b* and is spaced radially inward from the second arcuate channel 247*b*. The third arcuate channel 247*c* includes the closed portion 249*c* and the open portion 251*c*. The open portion 251*c* of the third arcuate channel 247*c* has a circumferential length $L_3$, a width $W_3$, and a cross-sectional area $CA_3$ (FIG. 16A). The length $L_3$ of the open portion 251*c* of the third arcuate channel 247*c* is less than the length $L_2$ of the open portion 251*b* of the second arcuate channel 247*b*. The widths $W_1$, $W_2$, $W_3$ and cross-sectional areas $CA_1$, $CA_2$, $CA_3$ of the open portions 251*a*, 251*b*, 251*c* of the arcuate channels 247*a*, 247*b*, 247*c* are substantially the same.

First junctures 257*a*, 257*b*, 257*c* between the closed portions 249*a*, 249*b*, 249*c* and the open portions 251*a*, 251*b*, 251*c* of the arcuate channels 247*a*, 247*b*, 247*c* are circumferentially offset from each other, and second junctures 259*a*, 259*b*, 259*c* between the closed portions 249*a*, 249*b*, 249*c* and the open portions 251*a*, 251*b*, 251*c* of the arcuate channels 247*a*, 247*b*, 247*c* are circumferentially aligned with each other. This arrangements results in the arcuate channels 247*a*, 247*b*, 247*b* being circumferentially offset from each other at one end and being circumferentially aligned with each other at the other end. As described in further detail below, for a given rotation speed of the rotary valve 233 and for a given volumetric flow rate of fluid from the pump 215, the dimensions and relative circumferential offset of the arcuate channels 247*a*, 247*b*, 247*c* can control the inflation timing and inflation pressure of the bladders 219*a*, 219*b*, 219*c* (FIG. 7).

Figure 7:
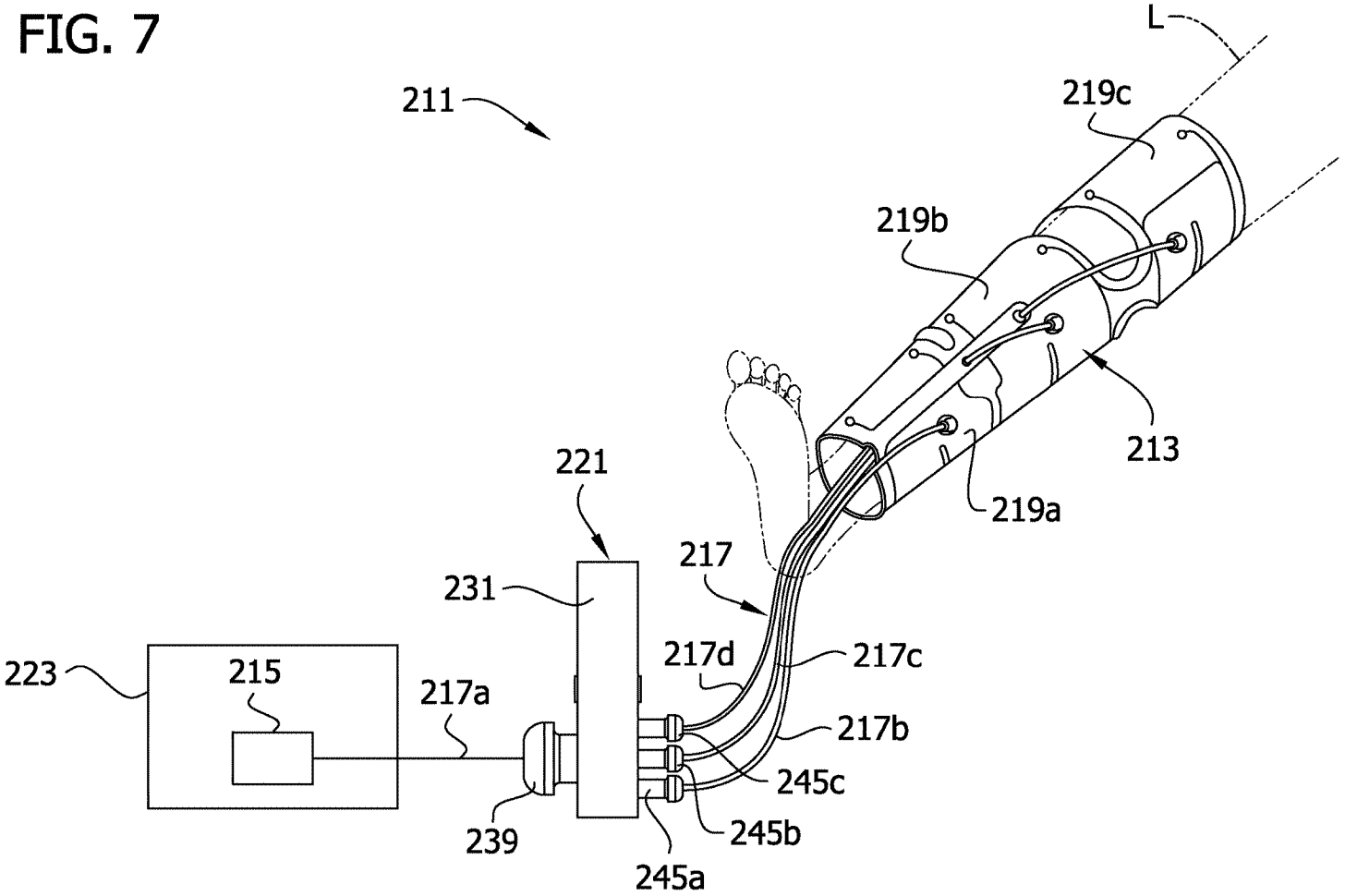
FIG. 7 is a schematic representation of a compression system including a compression garment applied to a subject's leg.
Figure 8:
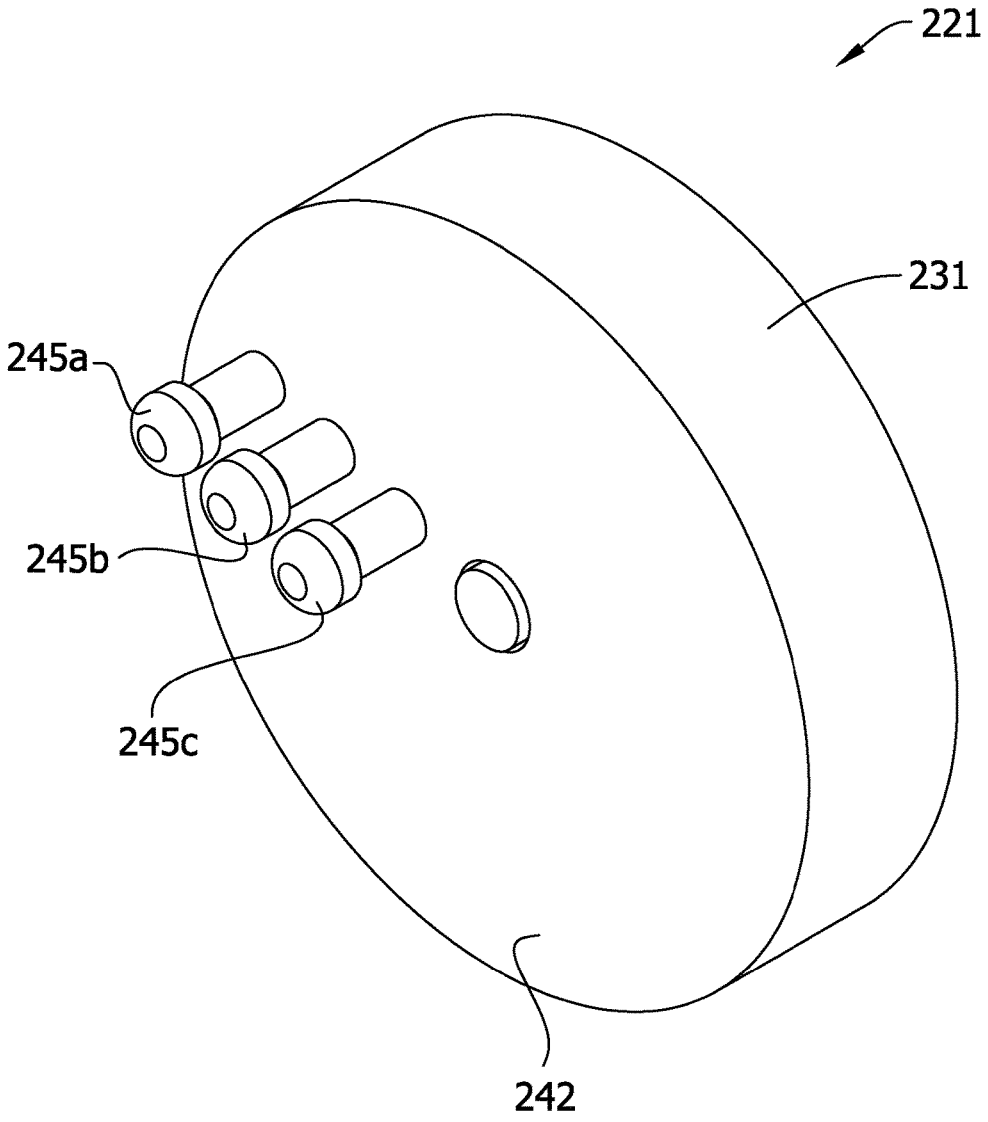
FIG. 8 is a front perspective view of a valve assembly of the compression system of FIG. 7.
Figure 9:
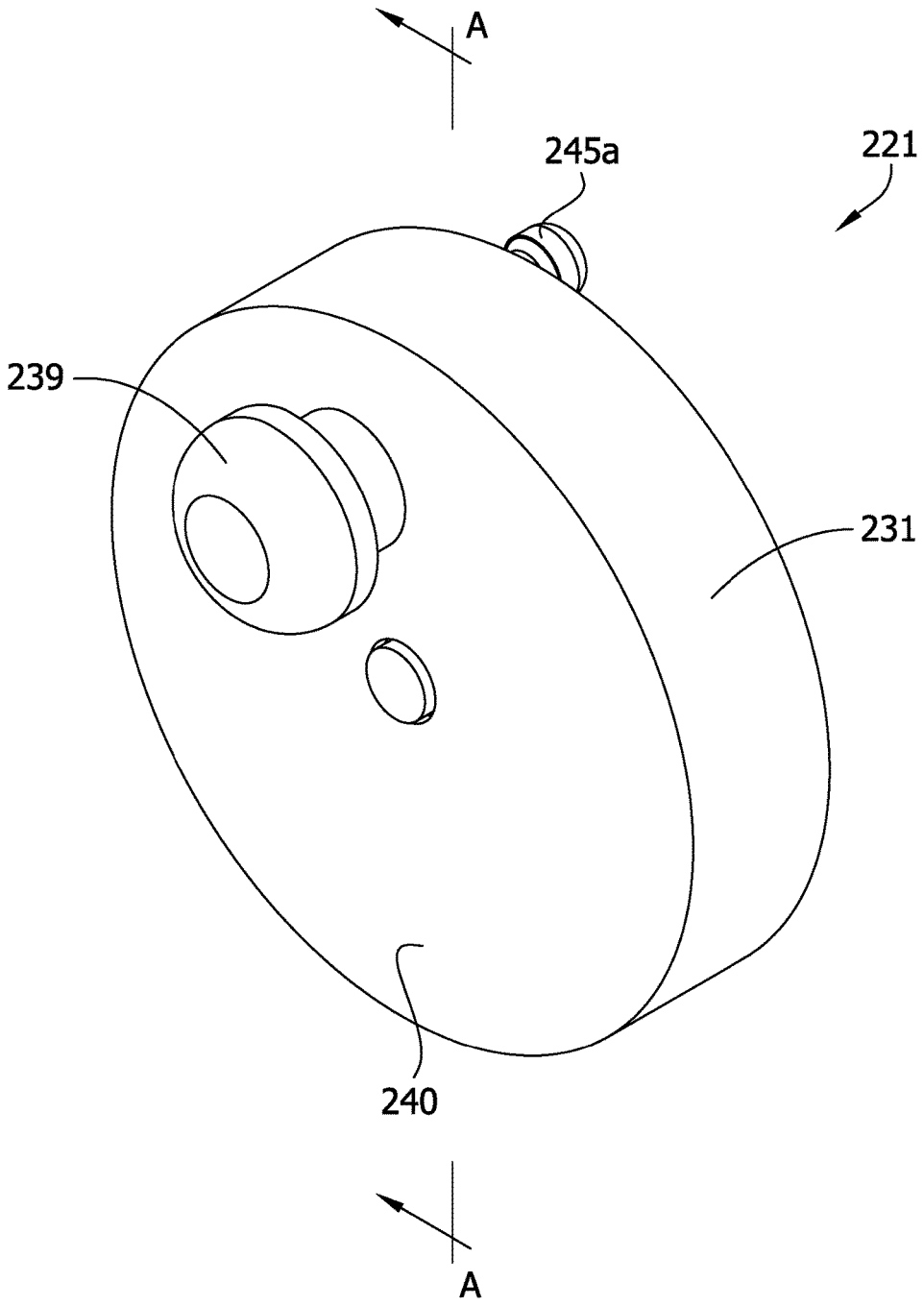
FIG. 9 is a rear perspective view of the valve assembly of FIG. 8.
Figure 10:
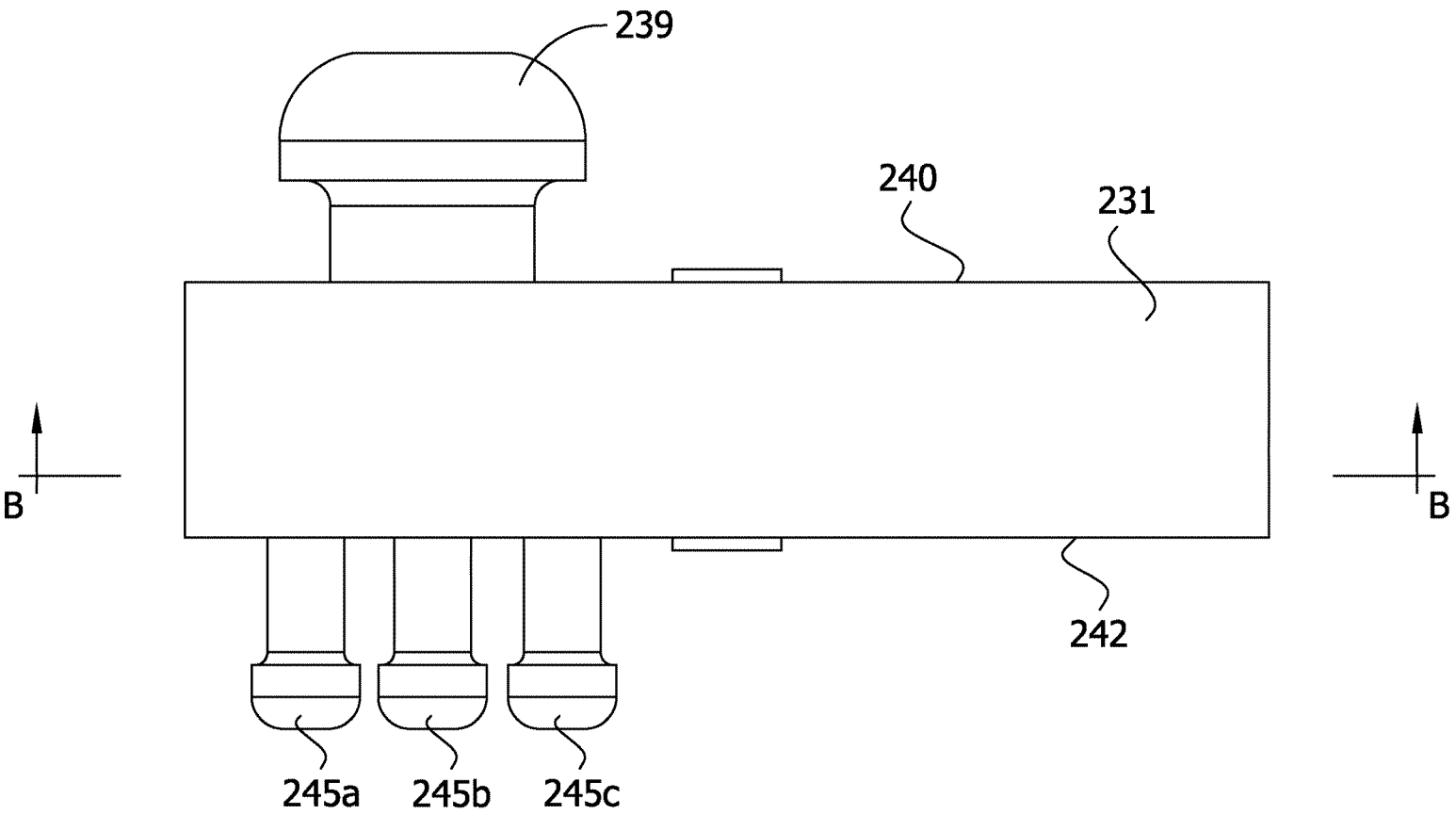
FIG. 10 is a side view of the valve assembly of FIG. 8.
Figure 11:
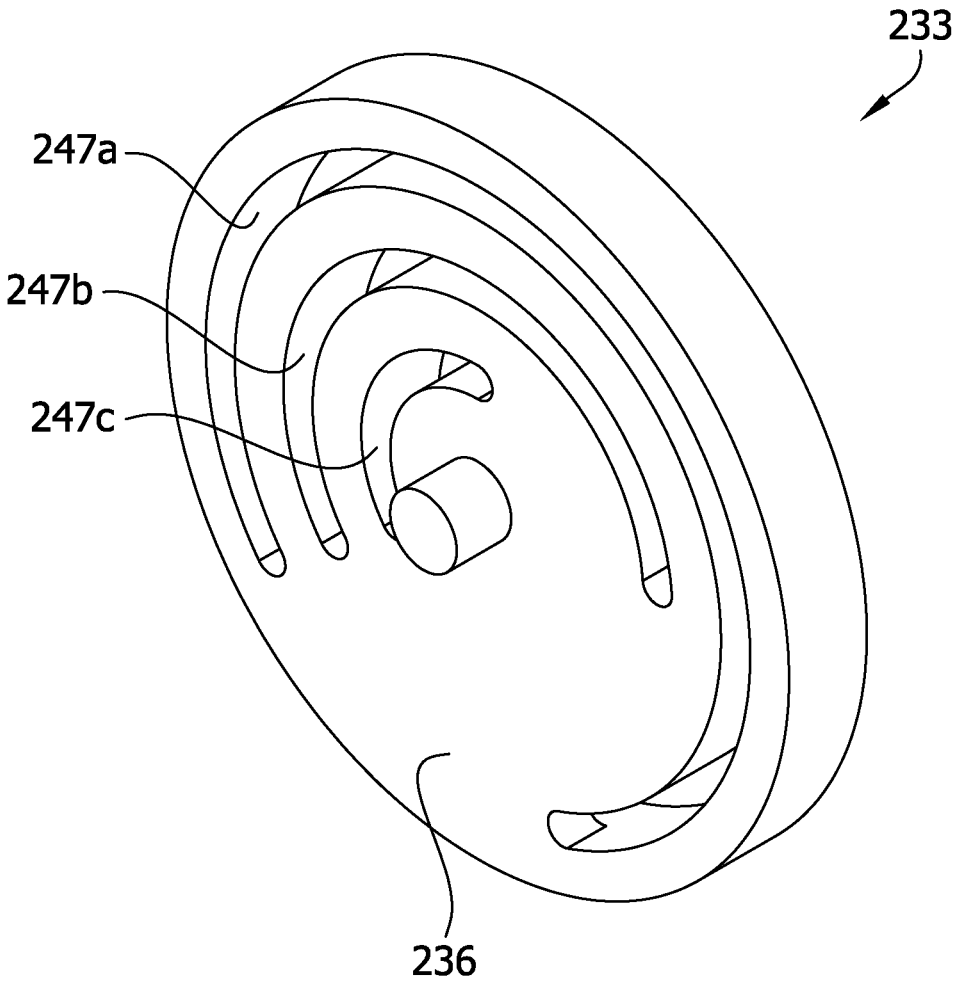
FIG. 11 is a perspective view of a disc-type rotary valve of the valve assembly of FIG. 7.
Figure 12:
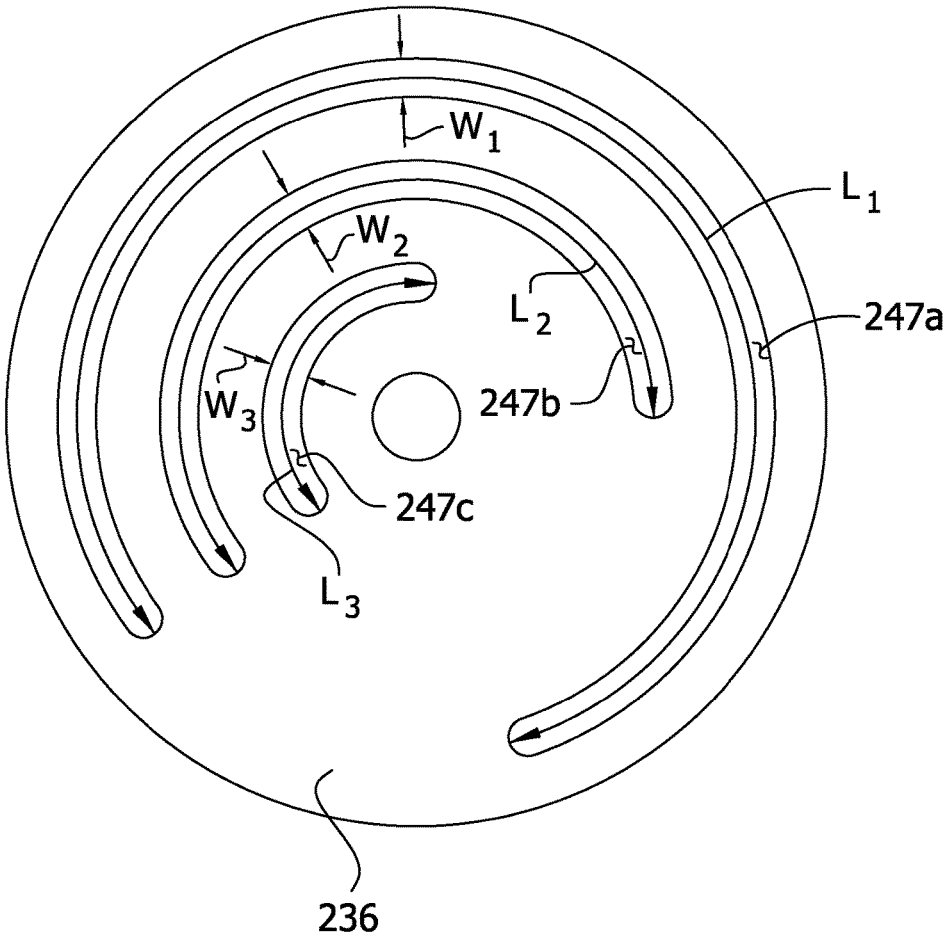
FIG. 12 is a front view of the disc-type rotary valve of FIG. 11.
Figure 13:
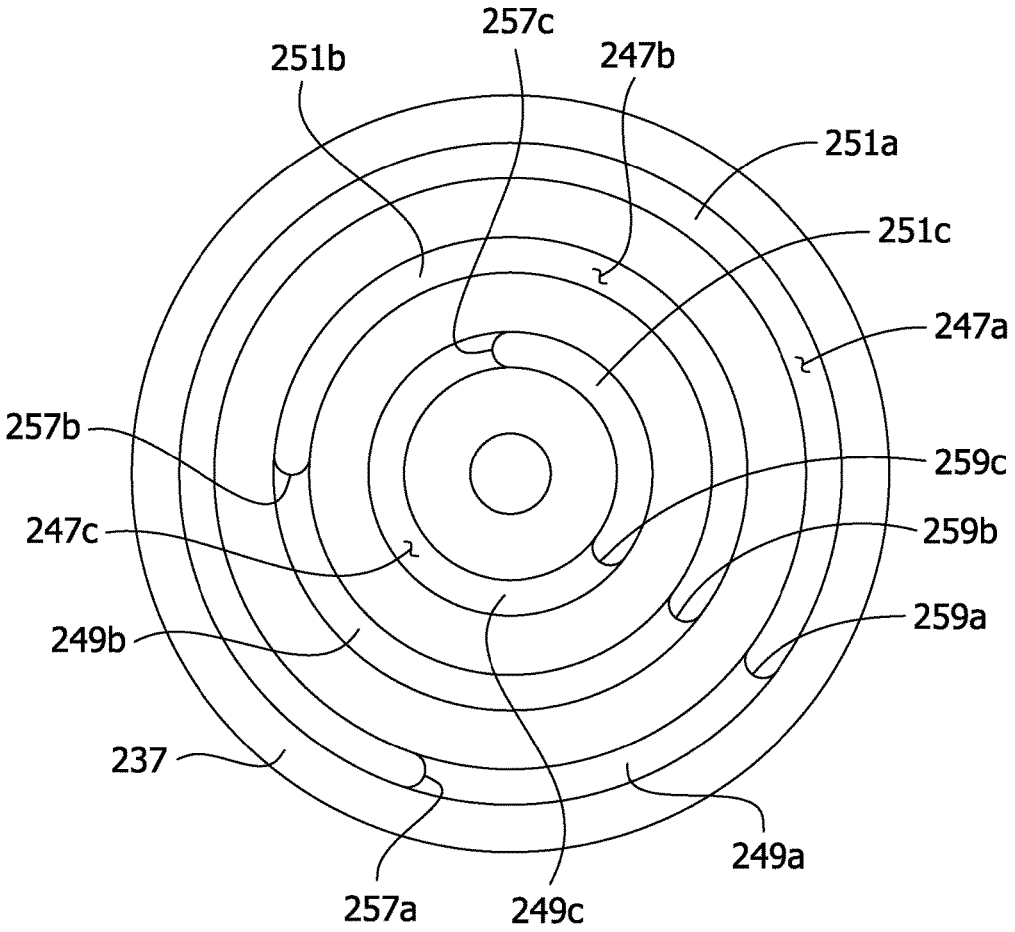
FIG. 13 is a back view of the disc-type rotary valve of FIG. 11.
Figure 14A:
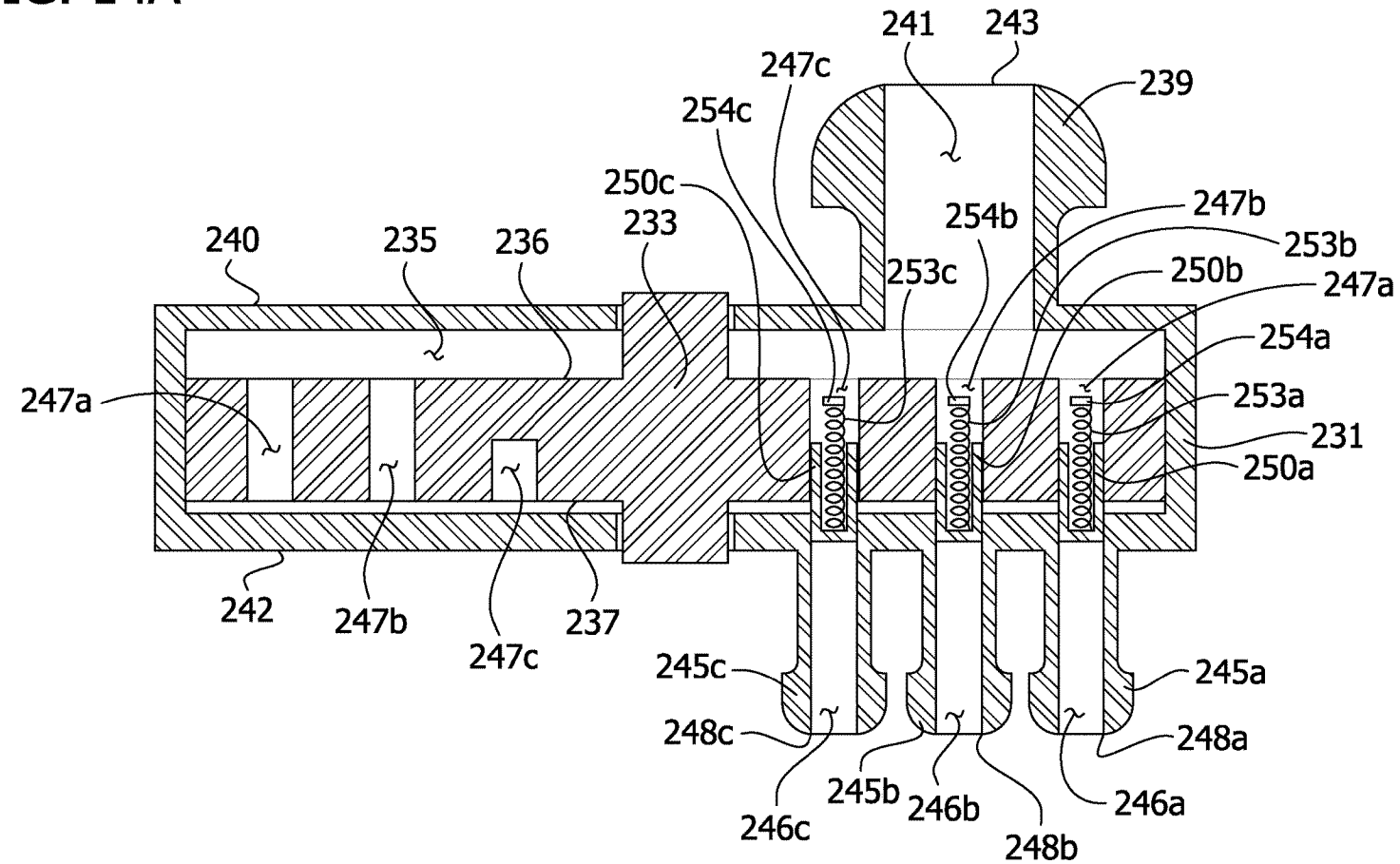
FIG. 14A is a cross-section of the valve assembly of FIGS. 7-10, taken through line A-A in FIG. 9, with the valve assembly shown in a first, vent position.
Figure 14B:
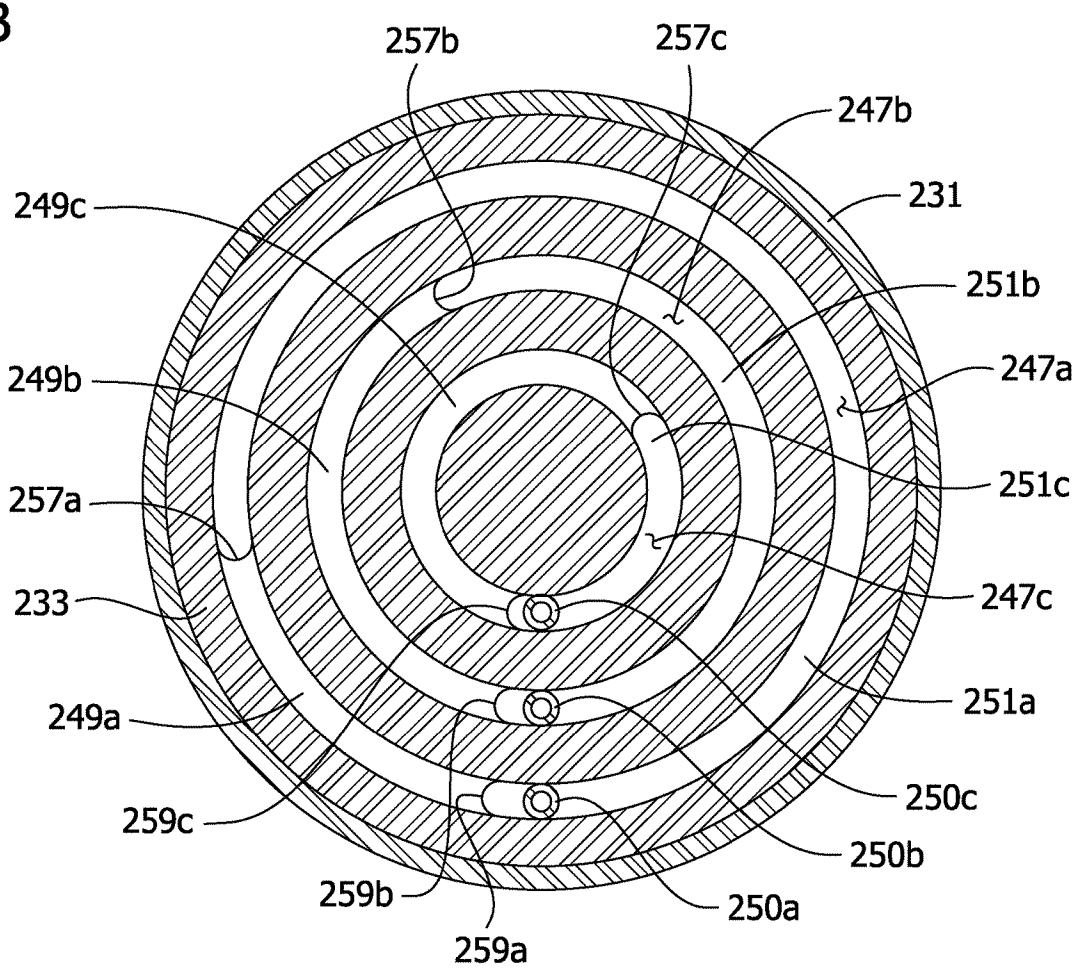
FIG. 14B is a cross-section of the valve assembly of FIGS. 7-10, taken through line B-B in FIG. 10, with the valve assembly shown in the first, vent position.

Referring to FIGS. 7, 14A, and 14B, the fluid port 239 of the valve assembly 221 is in fluid communication with a pump section 217*a* of tubing 217 such that the fluid port is in fluid communication with the pump 215. The first bladder port 245*a* is connected to a first bladder section 217*b* of the tubing 217 such that the first channel 247*a* is in fluid communication with the first bladder 219*a*. The second bladder port 245*b* is connected to a second bladder section 217*c* of the tubing 217 such that the second channel 247*b* is in fluid communication with the second bladder 219*b*. The third bladder port 245*c* is connected to a third bladder section 217*d* of the tubing 217 such that the third channel 247*c* is in fluid communication with the third bladder 219*c*.

During use, the pump 215 delivers pressurized fluid (e.g., air) through the pump section 217*a* of the tubing 217 to the passage 241 in the fluid port 239 of the valve 221. Prior to fluid entering the valve assembly 221, the valve assembly 221 is in an exhaust configuration in which the bladder ports 245*a*, 245*b*, 245*c* are in registration with the respective open portions 251*a*, 251*b*, 251*c* of the channels 247*a*, 247*b*, 247*c* adjacent the second juncture 259*a*, 259*b*, 259*c*, and the passage 241 in the fluid port 239 is in fluid communication, via the plenum 235, with each of the open portions 251*a*, 251*b*, 251*c* of the channels 247*a*, 247*b*, 247*c*. In this exhaust configuration, fluid in the bladders 219*a*, 219*b*, 219*c* is allowed to vent to atmosphere, and the springs 253*a*, 253*b*, 253*c* move the stops 254*a*, 254*b*, 254*c* to the open configuration such that the passages 246*a*, 246*c*, 246*c* in the bladder ports 245*a*, 245*b*, 245*c* are in fluid communication with the respective channels 247*a*, 247*b*, 247*c*.

Rotation of the rotary valve 233 in a first direction (counter-clockwise direction as shown in FIGS. 14B, 15B, 16B, 17B) results in the stops 254*a*, 254*b*, 254*c* engaging the respective closed portions 249*a*, 249*b*, 249*c* of the channels 247*a*, 247*b*, 247*c*. The engagement between the stops 254*a*, 254*b*, 254*c* and the respective closed portions 249*a*, 249*b*, 249*c* pushes the stops 254*a*, 254*b*, 254*c*, against the bias of the springs 253*a*, 253*b*, 253*c*, into respective closed configurations to close off fluid communication to the bladders 219*a*, 219*b*, 219*c*. In some embodiments, the second junctures 259*a*, 259*b*, 259*c* include a ramp. Such a ramp can facilitate gradual movement of the respective stop 254*a*, 254*b*, 254*c* from the open configuration to the closed configuration. The gradual movement of the respective stops 254*a*, 254*b*, 254*c* from the open configuration to the closed configuration can, for example, reduce mechanical stress exerted on the stops 254*a*, 254*b*, 254*c* by the respective second junctures 259*a*, 259*b*, 259*c* as the disc-type rotary valve 233 rotates. In certain embodiments, each valve element 250*a*, 250*b*, 250*c* further includes a respective guide (not shown) such as, for example, a rod extending through the respective spring 253*a*, 253*b*, 253*c* for guiding movement of the respective stop 254*a*, 254*b*, 254*c*.

Figure 15A:
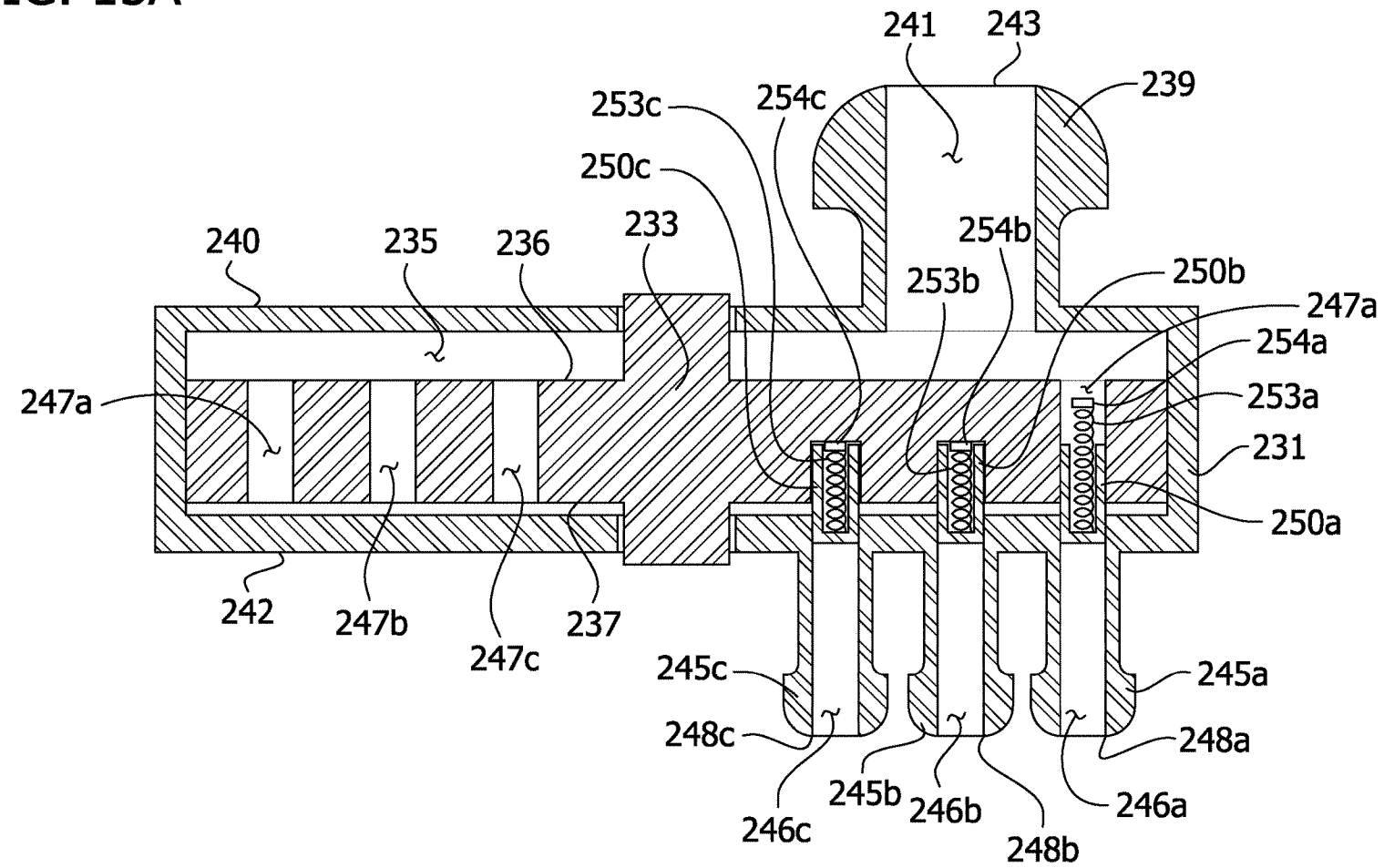
FIG. 15A is the cross-section of the valve assembly of FIGS. 7-10, taken through line A-A in FIG. 9, with the valve assembly shown in a second position.
Figure 15B:
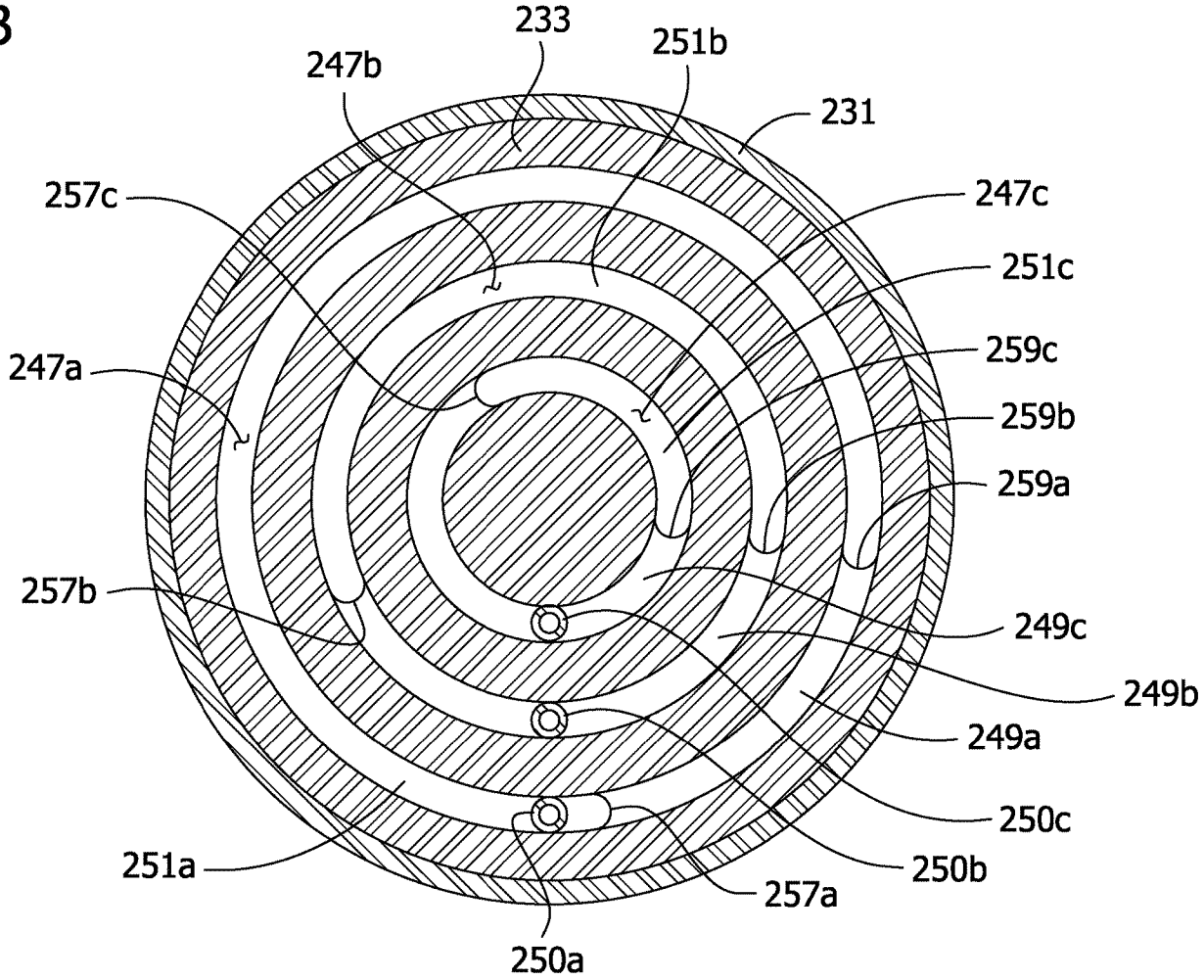
FIG. 15B is the cross-section of the valve assembly of FIGS. 7-10, taken through line B-B in FIG. 10, with the valve assembly shown in the second position.

Referring now to FIGS. 7, 15A, and 15B, further rotation of the disc-type rotary valve 233 (e.g., in response to activation of the pump 15), bringing the first bladder port 245*a* into registration with the open portion 251*a* of the first channel 247*a* adjacent the first juncture 257*a*. With the open portion 251*a* of the first channel 247*a* in this position, the stop 254*a* of the valve element 250*a* of the first bladder port 245*a* is moved, by the spring 253*a*, from the closed configuration to the open configuration. This places the passage 246*a* in the first bladder port 245*a* in fluid communication with the plenum 235, allowing fluid from the pump 215 to be delivered to the first bladder 219*a*.

Figure 16B:
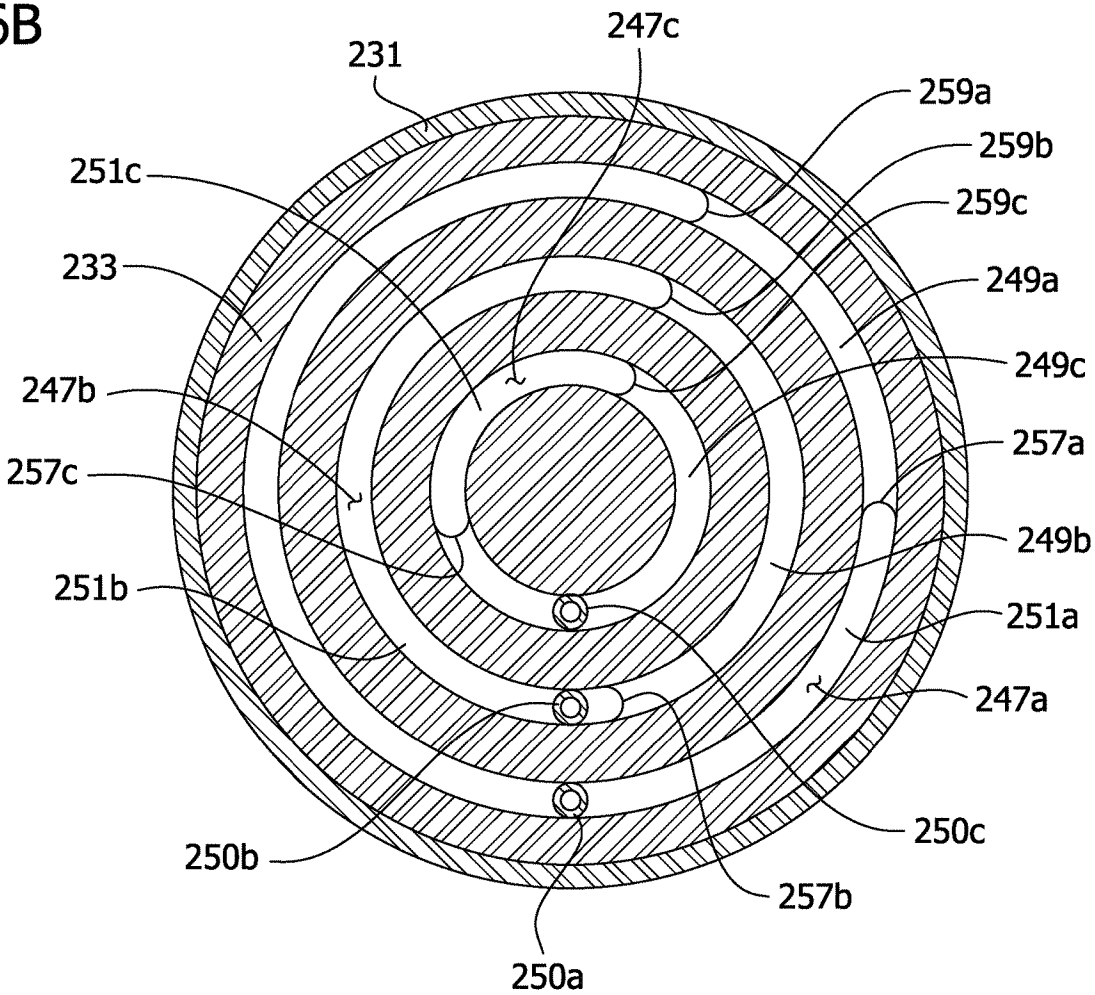
FIG. 16B is the cross-section of the valve assembly of FIGS. 7-10, taken through line B-B in FIG. 10, with the valve assembly shown in the third position.

Referring now to FIGS. 7, 16A, and 16B, continued rotation of the disc-type rotary valve 233 in the first direction brings the second bladder port 245*b* into registration with the open portion 251*b* of the second channel 247*b* adjacent first juncture 257*b*. With the open portion 251*b* of the second channel 247*b* in this position, the stop 254*b* of the valve element 250*b* of the second bladder port 245*b* is moved, by the spring 253*b*, from the closed configuration to the open configuration. The movement of the stop 245*b* from the closed configuration to the open configuration places the passage 246*b* in the second bladder port 245 in fluid communication with the plenum 235, allowing fluid from the pump 215 to be delivered to the second bladder 219*b*.

Figure 17A:
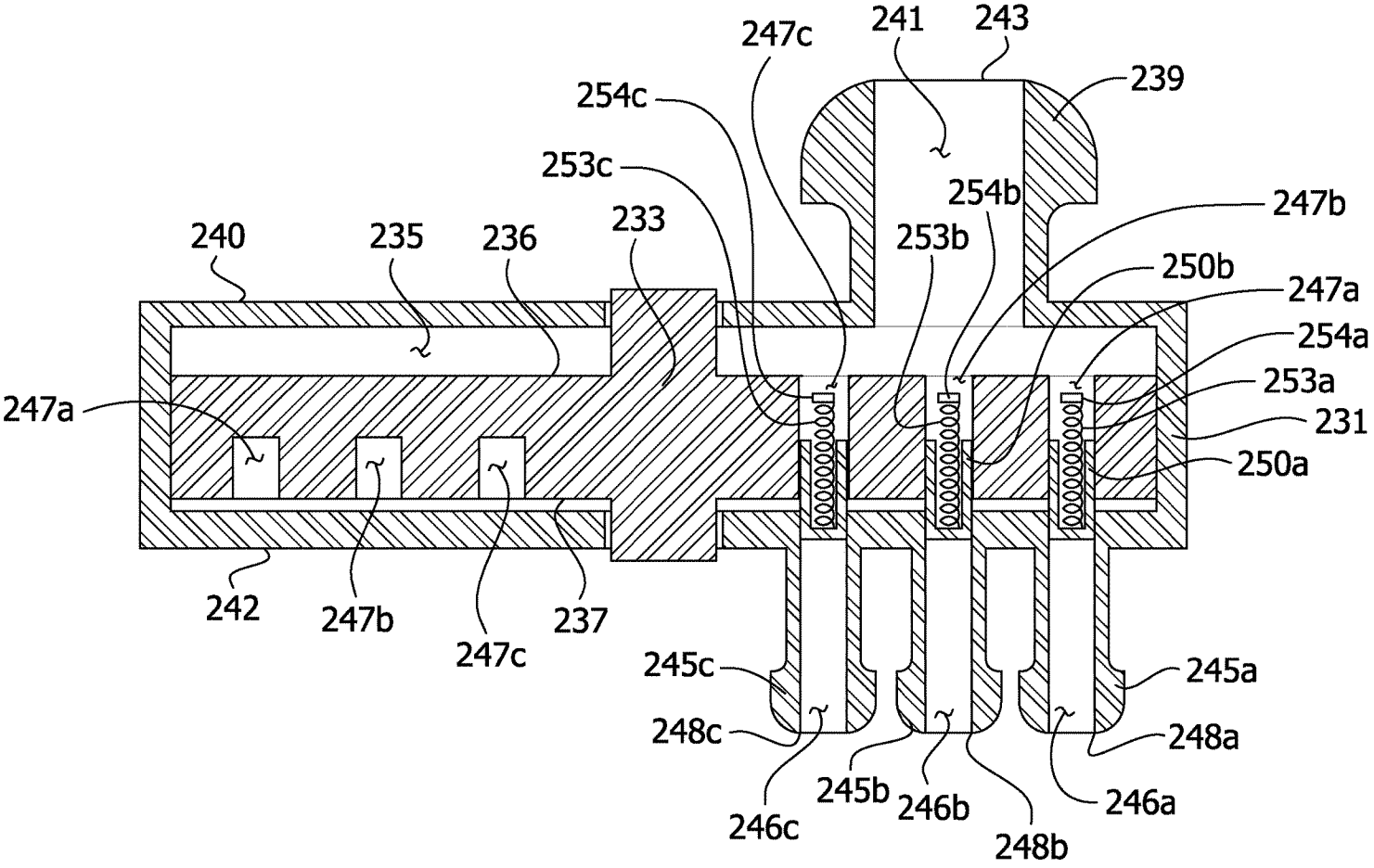
FIG. 17A is the cross-section of the valve assembly of FIGS. 7-10, taken through line A-A in FIG. 9, with the valve assembly shown in a fourth position.
Figure 17B:
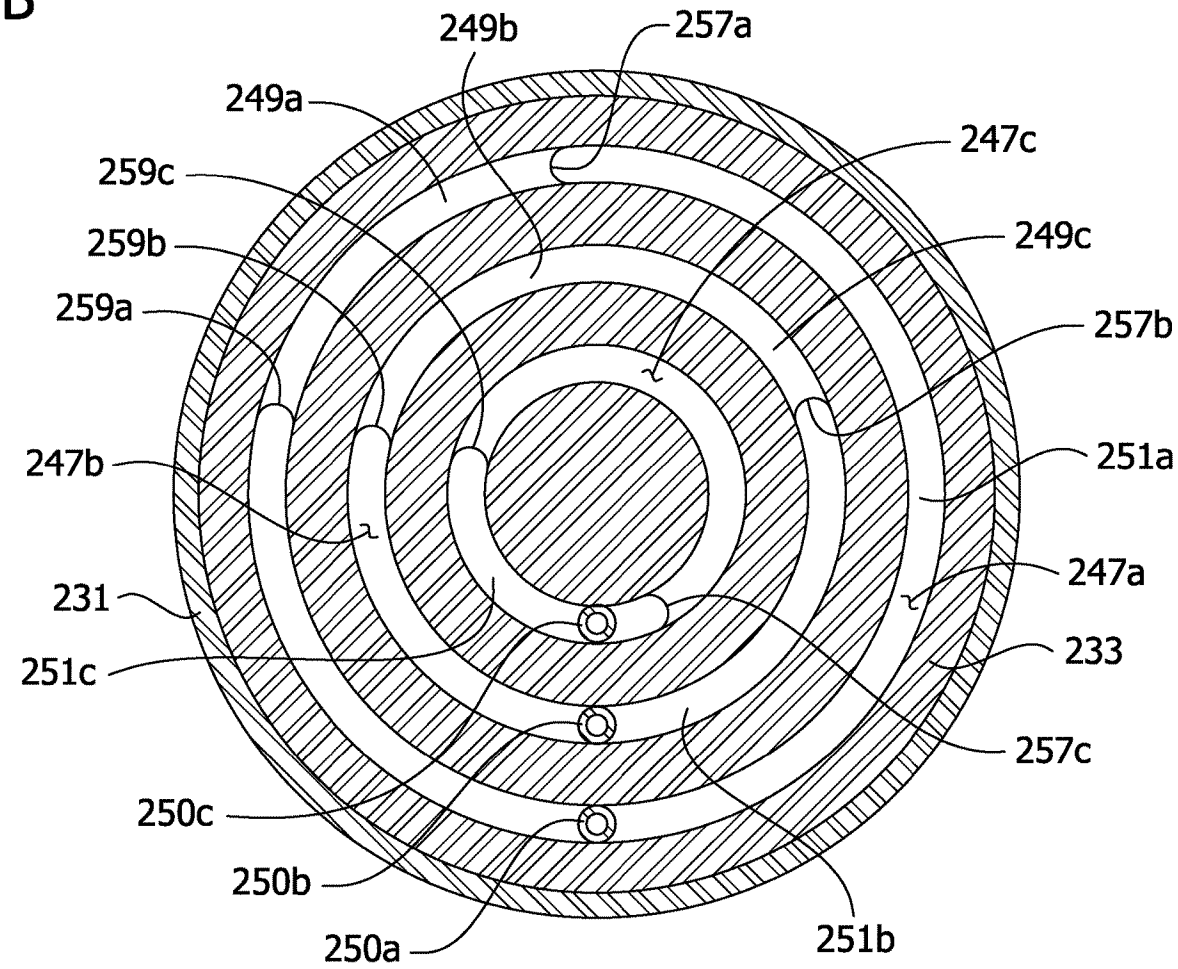
FIG. 17B is the cross-section of the valve assembly of FIGS. 7-10, taken through line B-B in FIG. 10, with the valve assembly shown in the fourth position.

Referring to FIGS. 7, 17A, and 17B, additional rotation of the disc-type rotary valve 233 in the first direction brings the third bladder port 245*c* into registration with the open portion 251*c* of the third channel 247*c* adjacent first juncture 257*c*. With the open portion 251*a* of the third channel 247*c* in this position, the stop 254*c* of the valve element 250*c* of the third bladder port 245*c* is moved by the spring 253*c* from the closed configuration to the open configuration. The movement of the stop 254*c* from the closed configuration to the open configuration places the passage 246*c* in the third bladder port 245*c* in fluid communication with the plenum 235, allowing fluid from the pump 215 to be delivered to the third bladder.

Thus, rotation of the disc-type rotary valve 233 of the valve assembly 221 facilitates sequential inflation of the bladders 219*a*, 219*b*, 219*c* of the compression garment 213 by sequentially placing the bladder ports 245*a*, 245*b*, 245*c* in fluid communication with the open portions 251*a*, 251*b*, 251*c* of the channels 247*a*, 247*b*, 247*c*. Additionally or alternatively, the valve assembly 221 can allow all three channels 247*a*, 247*b*, 247*c* to be in fluid communication with the fluid port 239 for simultaneously delivering fluid from the pump 215 to each bladder 219*a*, 219*b*, 219*c* of the garment 213 (e.g., when the rotary valve 233 rotates to a position placing the open portion 251*c* of the third channel 247*c* in fluid communication with the plenum 235).

To deflate the bladders 219*a*, 219*b*, 219*c*, the flow of fluid from the pump 215 to the compression garment 213 is interrupted (e.g., by turning off the pump 215) and the rotary valve 233 is rotated to the first, vent position (FIGS. 14A and 14B). This allows the fluid in the bladders 219*a*, 219*b*, 219*c* to deflate by exhausting the fluid to atmosphere (e.g., through an exhaust port (not shown) associated with the controller 223). When it is desired to sequentially inflate the bladders 219*a*, 219*b*, 219*c* to provide compression therapy to the wearer's limb, the pump 215 can be again activated to supply fluid to the valve assembly 221 and the rotary valve 233 can be rotated in the first direction to start the process over. It should be appreciated that the sequence of inflation and deflation of the bladders 219*a*, 219*b*, 219*c* can be repeated numerous times to deliver a desired therapy to a wearer of the compression garment 213.

In some embodiments, the disc-type rotary valve 233 rotates at a constant speed to provide cyclical compression. The activation and deactivation of the pump 215 can be, for example, a function of the position of the disc-type rotary valve 233 to achieve suitable coordination between the pump 215 and inflation/deflation of the compression garment 213.

Figure 18:
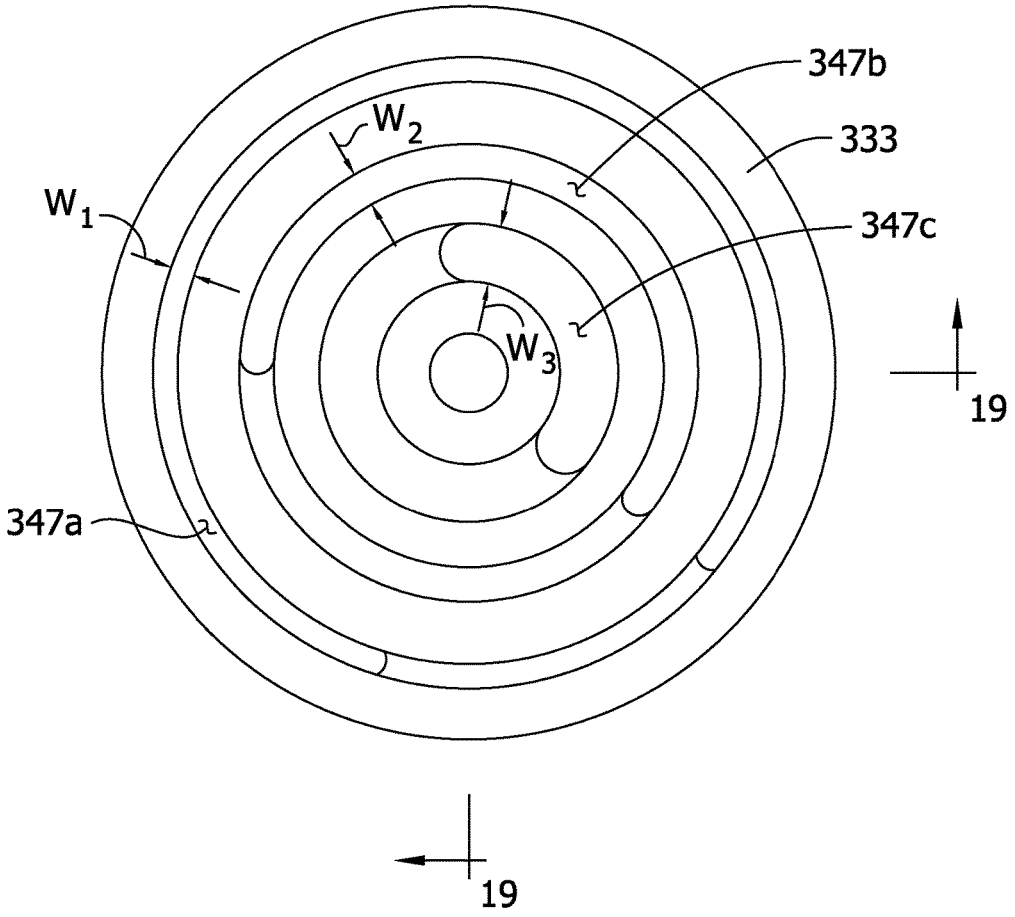
FIG. 18 is a back view of a disc-type rotary valve.
Figure 19:
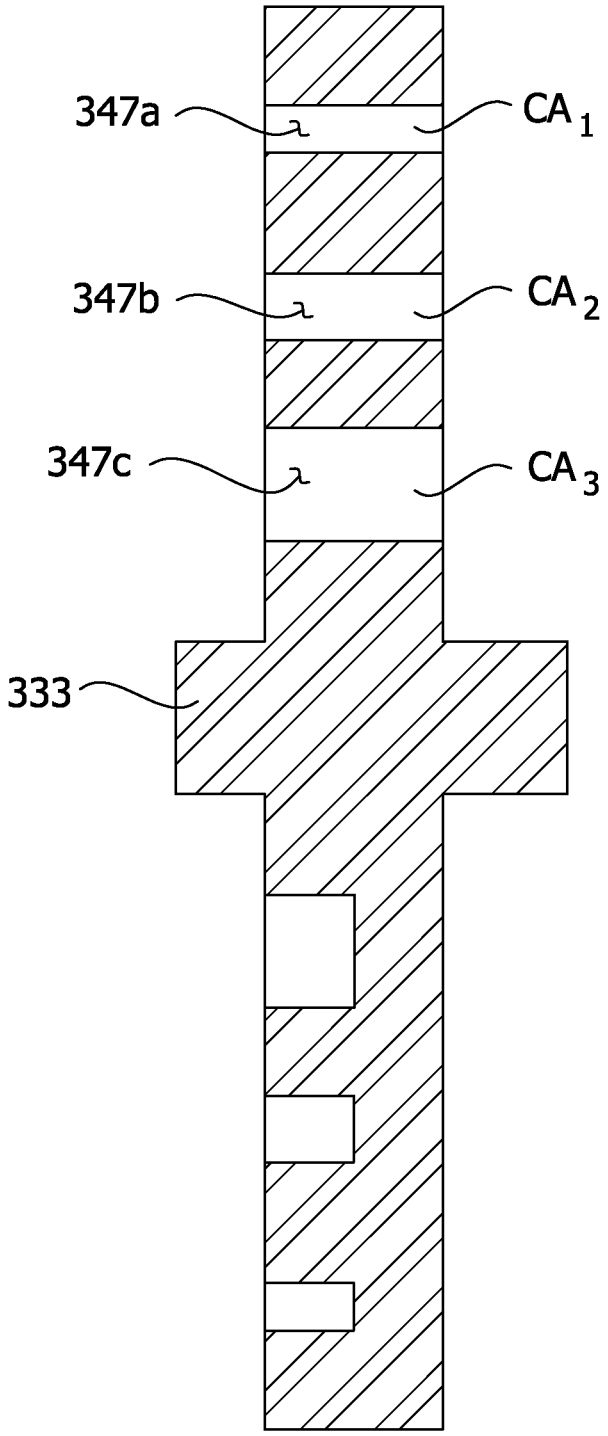
FIG. 19 is a section through line 19-19 of the disc-type rotary valve of FIG. 18.

While the widths of the channels defined by a disc-type rotary valve have been shown as having approximately the same width, other channel dimensions are additionally or alternatively possible to achieve a desired inflation profile of a compression garment. For example, referring to FIGS. 18 and 19, a disc-type rotary valve 333 can be used to control the flow of fluid in a compression garment of a compression system (e.g., the compression garment 213 of the compression system 211 in FIG. 7). The disc-type rotary valve 333 is interchangeable with the disc-type rotary valve 233 (FIGS. 11-17B) and is analogous to the disc-type rotary valve 233 except as otherwise described below.

The disc-type rotary valve 333 defines channels 347*a*, 347*b*, 347*c* having different widths $W_1$, $W_2$, $W_3$ and different cross sectional areas $CA_1$, $CA_2$, $CA_3$. The width $W_2$ of the second channel 347*b* is greater than the width $W_1$ of the first channel 347*a*. The cross sectional area $CA_2$ of the second channel 347*b* is greater than the cross sectional area $CA_1$ of the first channel 347*a*. The width $W_3$ of the third channel 347*c* is greater than the width $W_2$ of the second channel 347*b*. The cross sectional area $CA_3$ of the third channel 347*c* is greater than the cross sectional area $CA_2$ of the second channel 347*b*.

The rate at which bladders (e.g., bladders 219*a*, 219*b*, 219*c* in FIG. 7) in fluid communication with a valve assembly including the disc-type rotary valve 333 are inflated is determined in part by the cross sectional areas $CA_1$, $CA_2$, $CA_3$ of the channels 347*a*, 347*b*, 347*c*. Because the cross sectional area $CA_3$ is greater than the cross sectional area $CA_2$, fluid will be delivered to a third bladder (e.g., the third bladder 219*c* in FIG. 7) at a faster rate than the fluid is delivered to a second bladder (e.g., the second bladder 219*b* in FIG. 7). However, the second channel 347*b* has a larger cross sectional area $CA_2$ than the cross sectional area $CA_1$ of the first channel 347*a*. Thus, fluid will be delivered through the second channel 347*b* and into a second bladder (e.g., the second bladder 219*b* in FIG. 7) at a faster rate than fluid is delivered through the first channel 347*a* to a first bladder (e.g., the first bladder 219*a* in FIG. 7).

In operation, as the disc-type rotary valve 333 rotates, fluid begins to move through the first channel 347*a* before the fluid moves through the second and third channels 347*b*, 347*c*. Thus, the fluid begins filling a first bladder (e.g., the first bladder 219*a* in FIG. 7) in fluid communication with the first channel 347*a* before the fluid begins filling second and third bladders (e.g., the second and third bladders 219*b*, 219*c* in FIG. 7). However, because the first channel 347*a* has a width $W_1$ that is less than the widths $W_2$, $W_3$ of the respective second and third channels 347*b*, 347*c*, fluid is delivered through the first channel 347*a* to the first bladder at a slower rate than the fluid is delivered through the second and third channels 347*b*, 347*c* to the respective second and third bladders.

The fluid begins to be delivered through the second channel 347*b* after the fluid begins being delivered through the first channel 347*a*. However, the fluid is delivered through the second channel 347*b* at a rate faster than the delivery of the fluid through the first channel 347*a*.

The fluid begins to be delivered through the third channel 347*c* after the fluid begins being delivered through the second channel 347*b*. However, the fluid is delivered through the third channel 347*c* at a rate faster than the rate of fluid delivery through each of the first and second channels 347*a*, 347*b*.

A number of embodiments have been described. Nevertheless, it will be understood that various modifications may be made without departing from the spirit and scope of the disclosure. Accordingly, other embodiments are within the scope of the following claims.

What is claimed is:

1. A compression garment comprising:

a plurality of inflatable bladders positionable around a limb of a wearer;

a valve body defining a plurality of bladder ports, each bladder port in fluid communication with a respective inflatable bladder;

an inlet defining an inlet port;

an exhaust defining an exhaust port;

a rotary valve in fluid communication with the inlet port, the exhaust port, and the plurality of bladder ports, rotation of the valve in a first direction controlling fluid communication between the inlet port and the plurality of bladder ports, and rotation of the valve in a second direction, opposite the first direction, controlling fluid communication between the exhaust port and the plurality of bladder ports; and an energy storage device coupled to the rotary valve such that energy of rotation of the rotary valve in the first direction is storable in the energy storage device.

2. The compression garment of claim 1, wherein rotation of the rotary valve in the first direction brings the bladder ports sequentially into fluid communication with the inlet port.

3. The compression garment of claim 2, wherein rotation of the rotary valve in the second direction brings the bladder ports sequentially into fluid communication with the exhaust port.

4. A compression garment comprising:

a plurality of inflatable bladders positionable around a limb of a wearer;

an inlet defining an inlet port;

a valve body defining at least a portion of a manifold in fluid communication with the inlet port;

a plurality of bladder ports, each bladder port in fluid communication with a respective inflatable bladder;

a rotary valve in fluid communication with the manifold and the plurality of bladder ports, rotation of the valve in a first direction bringing the bladder ports sequentially into fluid communication with the inlet port; and an energy storage device coupled to the rotary valve such that energy of rotation of the rotary valve in the first direction is storable in the energy storage device.

5. The compression garment of claim 4, wherein the rotary valve is rotatable relative to the inlet and the manifold in a second direction to exhaust fluid.

6. The compression garment of claim 4, wherein the rotary valve comprises a valve member and a valve arm attached to the valve member, the valve arm projecting from the valve member for sliding sealing engagement with the valve body.

7. The compression garment of claim 6, wherein the valve body comprises an inner wall, the bladder ports opening into the manifold through the inner wall.

8. The compression garment of claim 7, wherein the valve arm is disposed in the valve body such that a free end of the valve arm is in sliding sealing contact with the inner wall of the valve body along the manifold.

9. The compression garment of claim 8, further comprising a stop disposed in the manifold, the valve arm engageable with the stop for preventing further rotation of the rotary valve in the first direction.

10. The compression garment of claim 6, wherein the valve arm is disposed with respect to the inlet such that the rotary valve is rotatable under the force of fluid moving through the inlet and impinging on the valve arm.

11. The compression garment of claim 4, further comprising an exhaust defining an exhaust port in fluid communication with the rotary valve, wherein the rotary valve is biased by the energy storage device to place the bladder ports in fluid communication with the exhaust port.

12. The compression garment of claim 11, further comprising a flap movable between a first position sealing the inlet when one or more of the bladders ports is in fluid communication with the exhaust, and a second position sealing the exhaust.

* * * * *